US010480891B2

(12) United States Patent
Eccleshall

(10) Patent No.: US 10,480,891 B2
(45) Date of Patent: Nov. 19, 2019

(54) RIFLE AND A FORESTOCK FOR A RIFLE WITH BIPOD

(71) Applicant: Steadystock NZ Limited, Palmerston, Otago (NZ)

(72) Inventor: Gary Stewart Eccleshall, Otago (NZ)

(73) Assignee: Steadystock NZ Limited, Palmerston, Otago (NZ)

( * ) Notice: Subject to any disclaimer, the term of this patent is extended or adjusted under 35 U.S.C. 154(b) by 0 days.

(21) Appl. No.: 16/099,396

(22) PCT Filed: May 8, 2017

(86) PCT No.: PCT/NZ2017/050055
§ 371 (c)(1),
(2) Date: Nov. 6, 2018

(87) PCT Pub. No.: WO2017/192055
PCT Pub. Date: Nov. 9, 2017

(65) Prior Publication Data

US 2019/0154394 A1 May 23, 2019

(30) Foreign Application Priority Data

May 16, 2016 (NZ) ..... 719837

(51) Int. Cl.
*F41A 23/10* (2006.01)
*F41A 23/08* (2006.01)
(Continued)

(52) U.S. Cl.
CPC ..... *F41A 23/10* (2013.01); *F41A 23/08* (2013.01); *F41A 23/04* (2013.01); *F41C 7/00* (2013.01); *F41C 23/16* (2013.01)

(58) Field of Classification Search
CPC ..... F41C 23/16; F41C 23/12; F41C 23/14; F41C 23/22; F41C 7/00; F41A 23/04; F41A 23/08; F41A 23/10
(Continued)

(56) References Cited

U.S. PATENT DOCUMENTS 4,776,124 A * 10/1988 Clifton ..... F41A 23/08 42/94
5,029,407 A * 7/1991 Kirkpatrick ..... F41A 23/10 42/94
(Continued)

FOREIGN PATENT DOCUMENTS

WO WO 2009/009663 A2 1/2009

OTHER PUBLICATIONS

International Search Report (PCT/NZ2017/050055), dated Sep. 8, 2017.
(Continued)

*Primary Examiner* — John Cooper
(74) *Attorney, Agent, or Firm* — Knobbe, Martens, Olson & Bear, LLP

(57) ABSTRACT

The invention relates to a rifle comprising a barrel, a stock, a bipod and bipod housing formed within the stock of the rifle and in which one or more legs of the bipod may be housed when the bipod is in a storage position. The forestock may comprise a body and a tip. The tip may be configured to support one or more legs of the bipod and may also be configured to hinge away from the body to cause the legs to project toward a supporting surface when the bipod is in an operational position.

19 Claims, 30 Drawing Sheets

(51) Int. Cl.
*F41A 23/04* (2006.01)
*F41C 7/00* (2006.01)
*F41C 23/16* (2006.01)

(58) Field of Classification Search
USPC ..... 42/94; 89/37.04, 40.06; 73/167
See application file for complete search history.

(56) References Cited

U.S. PATENT DOCUMENTS

| | | | | | |
|---|---|---|---|---|---|
| 5,852,892 | A * | 12/1998 | Bilgeri | F41A 23/08 | 42/94 |
| 7,770,320 | B1 * | 8/2010 | Bartak | F41C 23/16 | 42/72 |
| 7,992,339 | B2 * | 8/2011 | Hinds, Jr. | F41A 23/10 | 42/94 |
| 9,121,665 | B2 * | 9/2015 | Hinds | F41A 23/04 | |
| 9,410,762 | B2 * | 8/2016 | Ballard | F41A 23/08 | |
| 9,470,468 | B2 * | 10/2016 | McGinty | F41C 23/16 | |
| 9,784,521 | B2 * | 10/2017 | Bartak | F41A 23/10 | |
| 9,939,225 | B2 * | 4/2018 | Ravnaas | F41A 23/08 | |
| 2008/0307689 | A1 * | 12/2008 | Dotson | F41A 23/06 | 42/94 |
| 2019/0154394 | A1 * | 5/2019 | Eccleshall | F41C 23/16 | |

OTHER PUBLICATIONS

International Preliminary Report on Patentability in application No. PCT/NZ2017/050055 dated Dec. 8, 2017.

* cited by examiner

RIFLE AND A FORESTOCK FOR A RIFLE WITH BIPOD

SUMMARY OF THE INVENTION

In a first aspect, the invention provides a forestock for use in a rifle, wherein the forestock comprises a body and a tip, wherein the tip is configured to hinge downwardly from the forestock body, and wherein the forestock further comprises: a bipod housing comprising at least one bore that extends through the tip and into the body of the stock, and a bipod comprising at least one leg configured to slide back and forth within the bipod housing between a stored position, in which the leg is substantially held within the housing, and an extended position, in which the leg is substantially retracted from the housing.

TECHNICAL FIELD

The invention relates to a forestock, for use in a rifle, and a rifle comprising a forestock with an inbuilt bipod for supporting the rifle on a surface, such as the ground.

BACKGROUND OF THE INVENTION

Bipods are commonly used to provide a steady support for rifles, particularly when hunting.

U.S. Pat. No. 7,992,339 discloses a rifle with a bipod that is held within bores formed in the forestock housing when the bipod is not in use. The bipod comprises extendable legs that are attached to the front of the forestock with a bracket. The legs may be retracted from the housing and then extended, pivoted downwardly and splayed outwardly to an operational position. Tension springs are used to hold the legs in the splayed position. However, the tension springs tend to get caught on foliage when the hunter is carrying the rifle through the bush. The springs can also nip the skin of the hunter's hand if caught in one of the springs.

Other rifles include external bipods that are supported by the rifle forestock but that are held externally to the forestock. However, because the bipod is externally attached to the rifle, the legs, springs, and other components of the bipod tend to get caught in bush and scrub. These models also tend to make the rifle fore end heavy, which can put the rifle out of balance if the shooter is to take a standing shot.

It is therefore an object of the invention to provide a rifle forestock that goes at least some way towards overcoming the disadvantages of the prior art or at least provides a useful alternative to existing bipods.

SUMMARY OF THE INVENTION

In a first aspect, the invention provides a forestock for use in a rifle, wherein the forestock comprises a body and a tip that is moveable in relation to the forestock body and wherein the forestock further comprises: a bipod housing comprising at feast one bore that extends through the tip and into the body of the stock, and a bipod comprising at least one leg configured to slide back and forth within the bipod housing between a stored position, in which the leg is substantially held within the housing, and an extended position, in which the leg is substantially retracted from the housing.

In one form, the tip is attached to the forestock body via a pivot member comprising a first rotational member configured to rotate about a first axis to allow the tip to hinge downwardly from the body of the forestock when the bipod legs are in the extended position.

Preferably, the pivot member further comprises a second rotational member configured to rotate about a second axis, which is substantially orthogonal to the first axis, to allow the tip to pivot from side to side.

In one form, the bipod comprises a pair of legs.

Preferably, the bipod housing comprises a pair of bores, each bore being configured to store one of the bipod legs therein.

Preferably, the first rotational member comprises an angle adjuster comprising a first bore in which a first pivot shaft is located and wherein a longitudinal centre line of the first pivot shaft defines the first axis, and wherein the second rotational member comprises a sleeve comprising a second bore in which a second pivot shaft is located and wherein a longitudinal centre line of the second pivot shaft defines the second axis.

Preferably, the forestock comprises a lock configured to lock the tip in a hinged position.

In one form, the angle adjuster further comprises a first face, a second face substantially opposing the first face, and a side surface forming a locking surface between the first and second side faces, wherein the first bore extends through the angle adjuster from the first face to the second face and wherein the locking surface comprises one or more locking elements configured to engage with a lock to lock the position of the tip in relation to the forestock body.

Optionally, the locking surface comprises two or more locking elements and the lock is configured to engage with any of the locking elements allow the tip to be locked at different angles relative to the forestock body In one form, the lock is housed within a lock housing in the forestock body and wherein the lock comprises a locking member configured to project toward the angle adjuster and to engage with a locking element of the angle adjuster to lock the tip in position and to retract or rotate away from the angle adjuster to disengage with the locking element to unlock the position of the tip.

Preferably, the locking element comprises an abutment surface to press against the locking member in a locked position.

Optionally, the abutment surface is defined by a side surface of a recess formed in the angle adjuster, a side edge of an aperture formed in the angle adjuster, a side surface of a projection extending from the angle adjuster, or a lower surface of the angle adjuster.

In one form, the lock comprises a shaft, which is rotatable about its longitudinal axis, and a locking member projecting from the shaft, wherein rotating the shaft to a first position causes the locking member to engage with a locking element of the angle adjuster and rotating the shaft to a second position causes the locking member to disengage with the locking element.

Preferably, the Sock further comprises a gripping member extending from one end of the shaft and through an aperture in the forestock body.

In one form, the at least one bore of the stock comprises a flared opening.

In one form, each bipod leg comprises a proximal end that is held within the respective bore of the forestock and a distal end comprising a foot, and wherein the bipod comprises a biasing system that engages with the proximal ends of the bipod legs to move the proximal ends towards each other and to splay the feet apart when the bipod legs are in the extended position.

Preferably, the biasing system comprises a magnet located at the proximal end of each bipod leg to engage with a corresponding magnet located within the bipod housing.

Preferably, the bipod leg(s) comprised) a substantially elliptical lateral cross-section.

In a second aspect, the invention provides a rifle comprising a forestock according to the first aspect of the invention, and a barrel supported by the stock.

Also disclosed herein is a rifle comprising a stock, a barrel supported by the stock, and a bipod. The stock comprises a body, a tip and a bipod housing comprising at least one bore that extends through the tip and into the body of the stock. The bipod comprises a pair of legs configured to slide back and forth within the bipod housing between a stored position, in which the legs are substantially held within the housing, and an extended position, in which the legs are substantially retracted from the housing. The tip may be configured to hinge from the body of the stock and away from the barrel when the legs are in the extended position.

In one form, the bipod housing comprises a pair of bores, each bore being configured to store the bipod legs therein.

Optionally, the tip is configured to swivel from side to side when the legs are in the extended position.

In one form, the tip is attached to the body of the forestock via a connection system comprising a first pivot shaft extending in a first direction and a second pivot shaft extending in a second direction that is substantially orthogonal to the first direction. The connection system may comprise a pivot member comprising a sleeve comprising a first bore extending along the length of the barrel.

Preferably, the first pivot shaft extends through the first bore of the sleeve and attaches to the tip.

In one form, the pivot member further comprises a positioning member comprising a first side face, a second side face, and a locking surface extending between the first and second side faces, and wherein a second bore extends between the first and second side faces. Optionally, the positioning member projects from an outer surface of the sleeve.

The rifle may also comprise a locking system configured to lock the tip in a hinged position. The locking system may be configured to allow the tip to be locked at different angles relative to the barrel.

Optionally, the locking system comprises a retractable locking member provided in the forestock body and configured to engage with the hinge member.

In one form, the locking surface of the hinge member comprises one or more recesses or apertures configured to engage with the locking member.

In one form, the at least one bore of the stock comprises a flared opening.

In one form, each bipod leg comprises a proximal end that is held within the at least one bore of the stock and a distal end that comprises a foot for contacting a supporting surface; and the bipod comprises a biasing system configured to cause the proximal ends of the bipod legs to move towards each other and to splay the feet apart when the bipod legs are in the extended position. Optionally, the biasing system comprises a magnet located at the proximal end of each bipod leg to engage with a corresponding magnet located within the biped housing to cause the first end portions to move towards each other and to splay the feet apart.

In one form, rubberised feet are provided on the distal end of the bipod legs.

Optionally, the bipod leg(s) comprise(s) a substantially elliptical lateral cross-section.

In one form, the rifle further comprises a lock stop configured to engage with the tip to prevent the tip from moving between an operational position and a storage position. Optionally, the lock stop is configured to engage with the hinge member to prevent the tip from moving between an operational position and a storage position.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made.

Terms such as "top", "bottom", "upper", "lower", "front", "back", "left", "right", "rear", and "side" describe the orientation and/or location of portions of the components or elements within a consistent but arbitrary frame of reference which is made clear by reference to the text and the associated drawings describing the components or elements under discussion. Moreover, terms such as "first", "second", "third", and so on may be used to describe separate components. Such terminology may include the words specifically mentioned above, derivatives thereof, and words of similar import.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

BRIEF DESCRIPTION OF THE FIGURES

Preferred embodiments of the invention will be described by way of example only and with reference to the drawings, in which.

DETAILED DESCRIPTION

Figure 1:
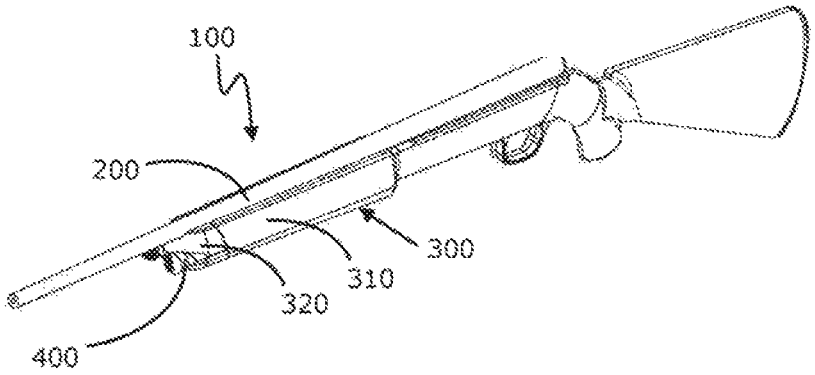
FIG. 1 is a perspective view of a rifle comprising a bipod in a storage position according to one form of the invention.

A shown in FIGS. 1 to 18*b*, the invention relates to a forestock 300 for a rifle 100, and to a rifle 100 comprising a forestock 300. The forestock is formed in two parts and may also comprise an inbuilt bipod. The two part forestock 300 comprises a first part in the form of a forestock body 310 and a second part in the form of a tip 320 located at the distal end of the forestock body 310. Both the body 310 and tip 320 may be configured to store the bipod by providing a bipod housing that extends through the tip and into the forestock body when the forestock body and tip are substantially aligned in a storage position. For example, the tip 320 may be configured to move from a first position to a second position in relation to die body 310. In one form, the tip may move from a storage position to an operational position. In the storage position, the tip and body are substantially aligned and flush with each other and a portion of the barrel 200 is supported by an upper surface of the tip 320, as shown in FIG. 1. In the operational position, the tip 320 is hinged/pivoted downwardly, away from the barrel 200 and stock body 310, to project towards the ground or other supporting surface beneath the rifle 100. The tip 320 may also be configured to pivot from side to side in relation to the body 310.

Figure 2:
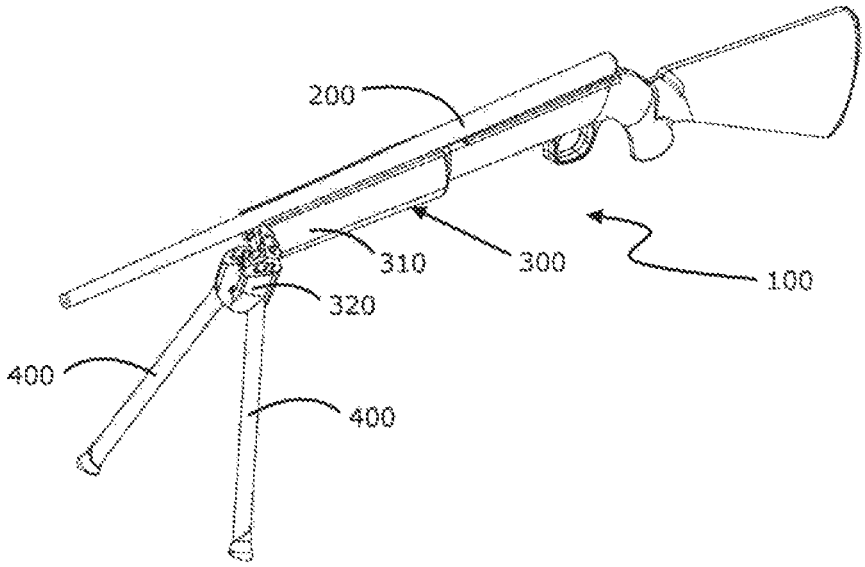
FIG. 2 is a perspective view of the rifle of FIG. 3 with the bipod in an operational position.

FIGS. 1 and 2 show a rifle 100 comprising a barrel 200 and a two part stock 300 according to one form of the invention. The barrel 200 is positioned on top of and is supported by the stock 300. The tip 320 is located at the distal end of the stock, beneath the barrel of the rifle.

The stock 300 may comprise a channel 321 that extends substantially centrally along the length of an upper surface of the stock. The channel 321 extends across both the body 310 and tip 320 of the stock. The portion of the channel 321 formed in the tip can be seen in FIG. 2. The barrel 200 of the rifle may be at least partially located in the channel 321, so that the stock 300 locates and supports the barrel 200 substantially centrally along its length.

The rifle 100 also comprises a bipod, comprising a pair of bipod legs 400 configured to be housed within a bipod housing formed in the stock 300.

FIGS. 3*a* to 3*d* show one form of bipod leg 400 that may be used with the rifle 100 or forestock 300 of the invention. Each bipod leg 400 comprises an elongate body having a proximal end 401 and a distal end 402. The elongate body of each leg comprises an outer surface and two end surfaces. The bipod leg 400 may be of any suitable shape, but preferably comprises a substantially regular circular or elliptical lateral cross-section. In a preferred form, the bipod leg may flare outwardly at its distal end 402 to provide a greater surface area with which to support the rifle on the ground.

The distal end 402 of each bipod leg 400 comprises a foot 420 configured to contact a supporting surface, such as the ground, when the bipod is in use. In one form, the end surface of the distal end 402 of the bipod leg may act as a foot 420, so that the foot 420 is integral with the bipod leg 400. In another form, a foot 420 may be attached to the distal end 402 of the bipod leg, such as by pushing the foot 420 into a foot receiving aperture located at the distal end 402 of the leg 400 or pushing an outer lip of the foot 420 over the outer side surface of the distal end 402 of the leg 400, for example. Other suitable configurations for attaching a foot 420 to a bipod leg 400 may also be used. For example, the foot may be formed of a plastic material that is overmoulded onto the bipod leg. In another form, the foot may be welded or adhered to the bipod leg. Optionally, the foot 420 and/or bipod leg 400 is/are configured so that the foot 420 is removably attached to the bipod leg 400. This configuration allows the foot 420 to be replaced if necessary. For example, the foot 420 may comprise a threaded region at one end that is configured to screw onto or into a corresponding threaded region of the distal end 402 of the bipod leg 400.

The foot 420 may be formed of a firm material, such as a hardened plastic, wood, metal, or a hardened rubber. Alternatively, the foot may be formed of a rubberised material comprising a cushioned or soft material, such as rubber, silicone, or a soft plastic or elastomer or a combination of materials. A rubberised foot provides at least some shock absorption of the recoil force when the rifle is fired.

Figures 3A, 3B, 3C:
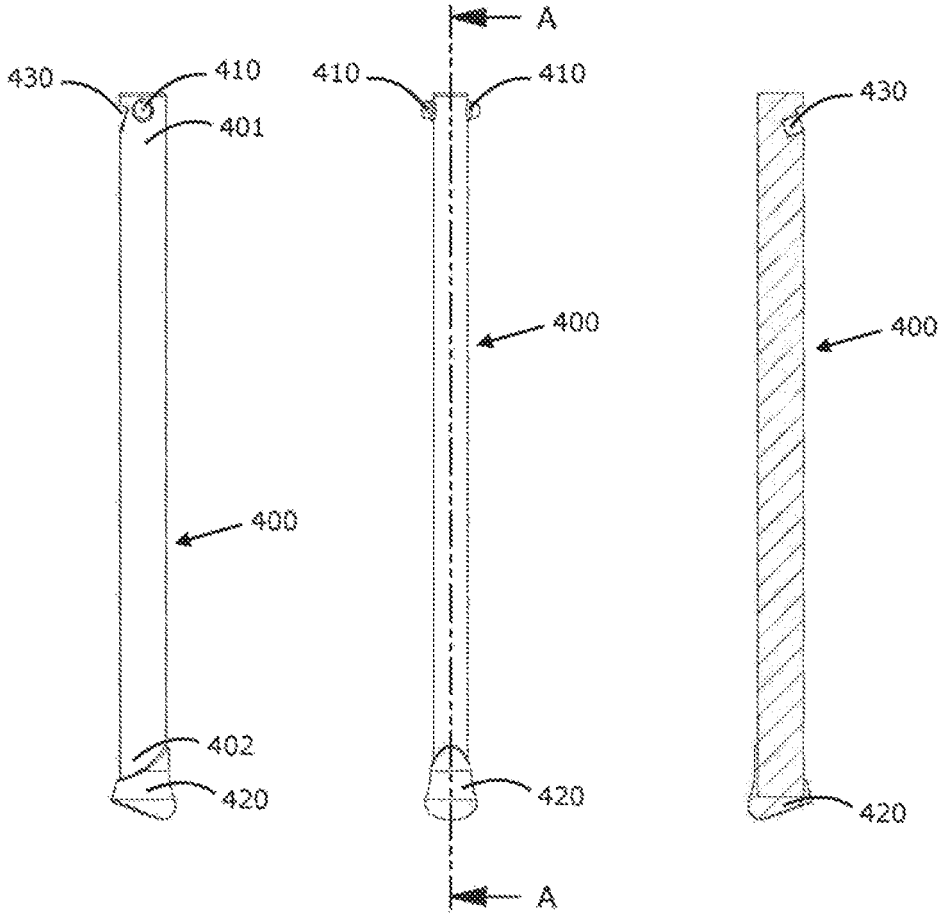
FIG. 3*a* is a side view of one form of bipod leg.
FIG. 3*b* is another side view of the bipod leg of FIG. 3*a;*
FIG. 3*c* is a cross-sectional side view of the bipod leg taken along lines A-A of FIG. 3*b;*
Figure 3D:
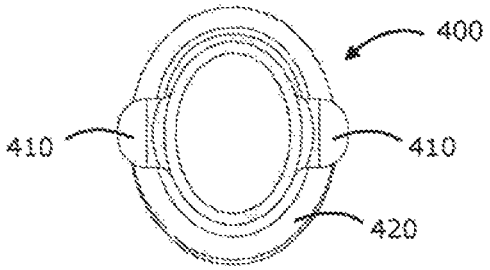
FIG. 3*d* is an end view of the bipod leg of FIGS. 3*a* to 3*c;*

In one form, as shown in FIGS. 3*a* and 3*c*, the foot 420 may comprise a non-slip or textured surface to assist the foot to grip the ground. For example, the end surface of the foot 420 may comprise one or more ribs, cross-hatching, raised stipples, or the like to provide texture.

The bipod housing may comprise one or more bores 330 in which the bipod legs 400 may be housed. In one form, the bipod housing may comprise a single oblong bore 330 that extends through the tip 320 and into the body 310 of the stock. The bore 330 may be configured to house a single bipod leg or a pair of bipod legs 400 in a side by side arrangement.

Figure 4A:
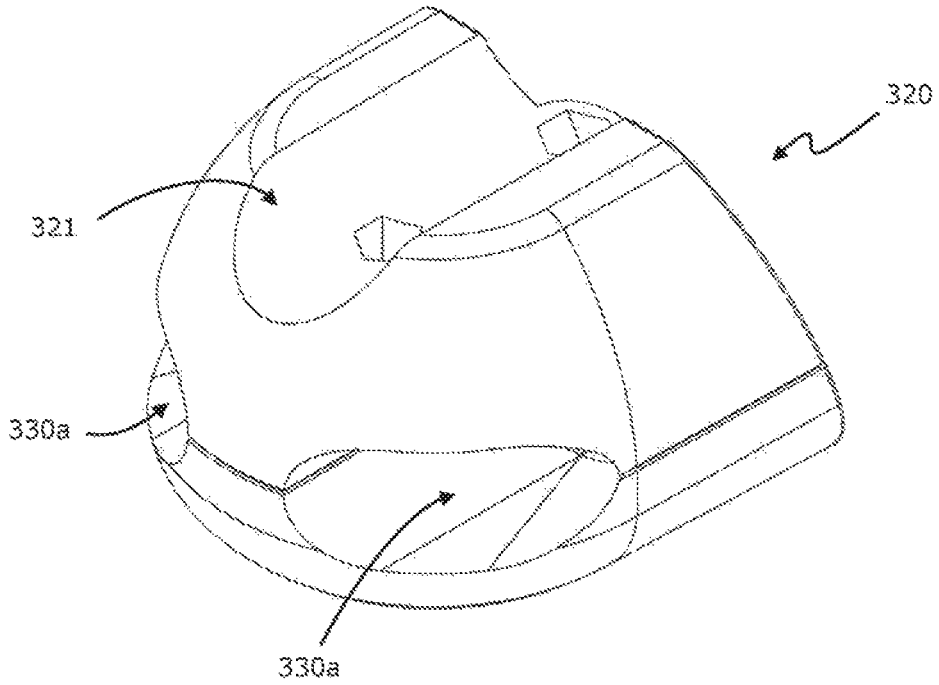
FIG. 4*a* is a front perspective view of a tip of a forestock according to one form of the invention.
Figure 4B:
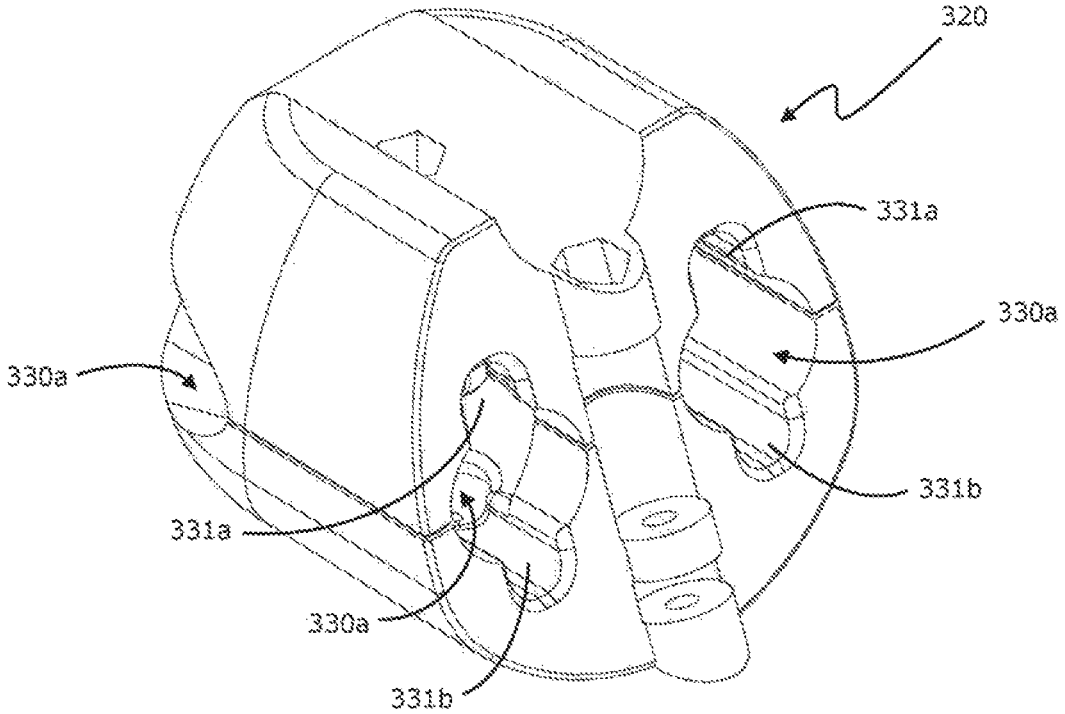
FIG. 4*b* is a rear perspective view of the tip of FIG. 4*a;*
Figure 4C:
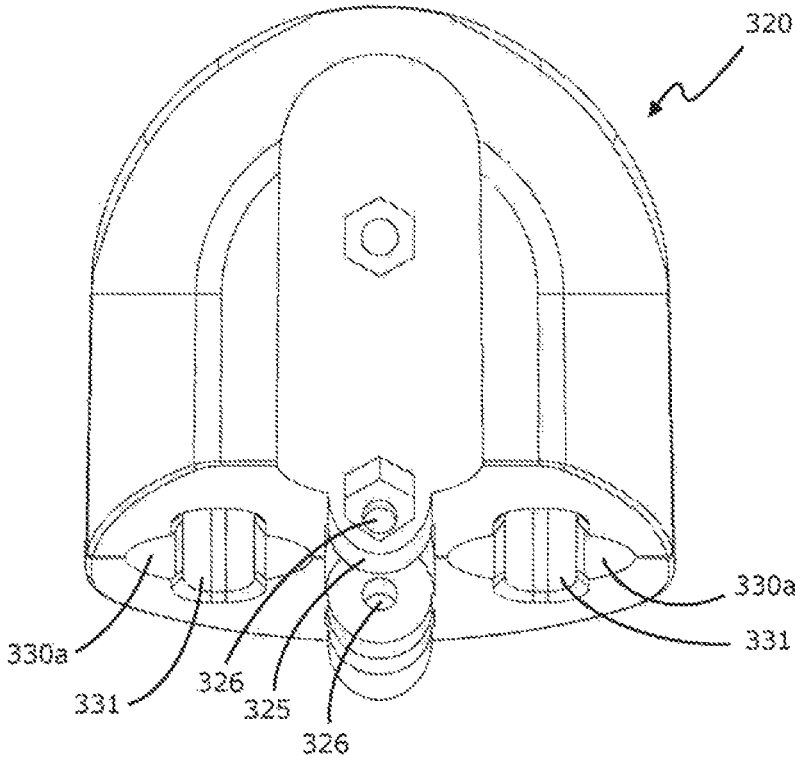
FIG. 4*c* is a top view of the tip of FIG. 4*a;*
Figure 4D:
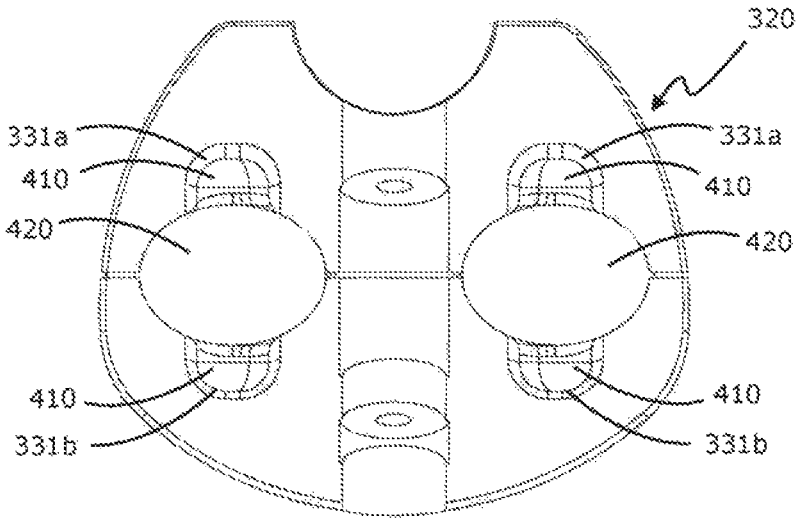
FIG. 4*d* is a front view of the tip of FIG. 4*a* in which bipod legs are housed within the forestock.
Figure 4E:
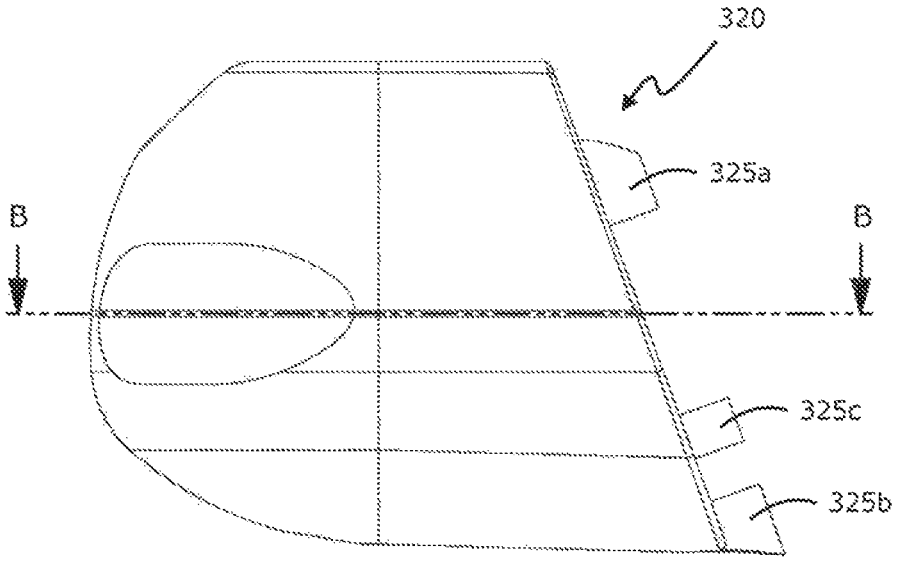
FIG. 4*e* is a side view of the tip of FIG. 4*a;*
Figure 4F:
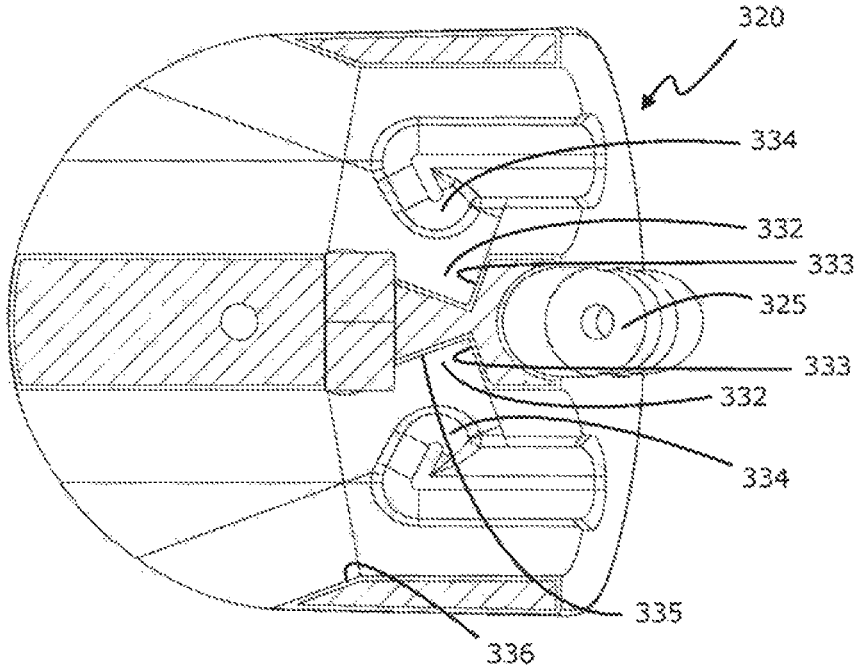
FIG. 4*f* is a cross-sectional top view taken along line B-B of the tip shown in FIG. 4*e;*
Figure 5A:
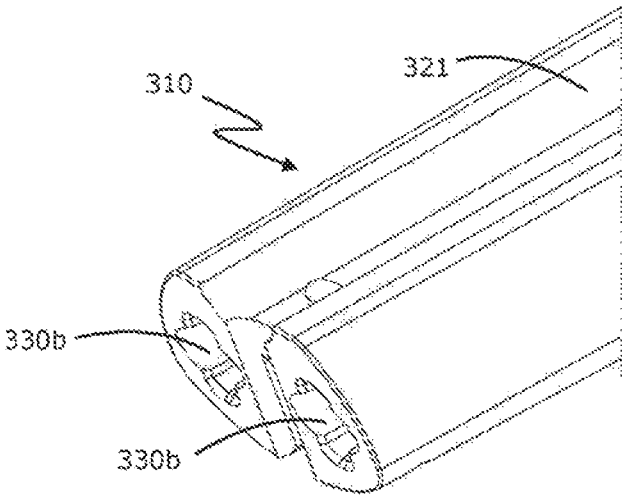
FIG. 5*a* is a perspective view of the forestock body showing bores extending into the body.
Figure 5B:
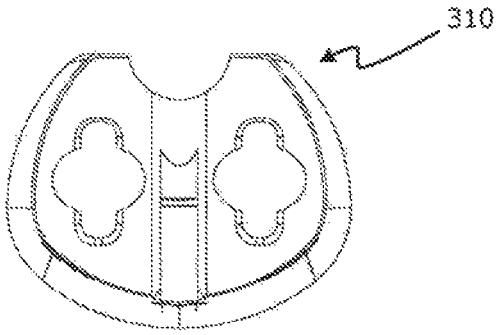
FIG. 5*b* is an end view of the forestock body of FIG. 5*a;*

In another form, as shown in FIGS. 4*a* to 5*b*, the bipod housing comprises a pair of bores 330 that extend through the tip 320 and into the body 310 of the stock 300. In this form, the tip 320 comprises a pair of bores 330*a* that extend from the distal end of the tip to the proximal end of the tip, as shown in FIGS. 4*a* to 4*f*. The stock body 310 also comprises a pair of bores 330*b* that extend from the distal end of the stock body and into the stock body in a longitudinal direction, as shown in FIGS. 5*a* and 5*b* for example. The bores 330*a* of the tip 320 substantially align with the bores 330*b* of the stock body 310 when the tip 320 aligns with the stock body in the storage position. In this position, each aligned bore 330*a*, 330*b* acts as a single bore 330 extending into the forestock 300 from the distal end of the tip 320.

Each bore 330 of the bipod housing may comprise a virtual vertical centre line, which extends vertically through a central point and along the length of the bore when the stock is held in a horizontal plane. In this specification, the portion of the bore that is on the side of the vertical centre line closest to the longitudinal centre fine of the stock is referred Co as the inner hemisphere of the bore. The portion of the bore that is on the side of the vertical centre line closest to the outside of the stock is referred to as the outer hemisphere of the bore.

Each bore 330 may also comprise a virtual horizontal centre line, which extends horizontally through the central point and along the length of the bore when the stock is held in a horizontal plane. In this specification, the portion of the bore that is above the horizontal centre line is referred to as the upper portion of the bore. The portion of the bore that is below the horizontal centre line is referred to as the lower portion of the bore.

The bipod legs 400 and the bores 330 may be configured so that the legs 400 can slide along the bores 330 to substantially retract into the bipod housing when in a storage position or to substantially extend from the housing when the bipod is in an operational position. A preferred form of this arrangement will be described in further detail later in this specification.

In one form, the bipod housing and bipod leg(s) are configured to prevent the leg(s) from fully retracting from the housing. For example, each bipod leg may comprise one or more stops 410 located at or near the proximal end 401 of the leg. The stops 410 are configured to engage with the tip 320 to retain an attachment between the tip and bipod legs 400 so that the legs cannot be removed from the stock 300.

In one form, each stop 410 may comprise one or more projections, such as nubs, that project from the outer surface of the bipod leg. Each bore 330*a* of the tip may comprise one or more corresponding terminal stops configured to engage with the stop(s) 410 of the respective leg to hold the leg within the tip 320. In this arrangement, when the legs 400 project from the bipod housing in the fully extended position, the proximal end 401 of each leg 400 will remain held within the respective bore 330.

In one form, each bipod leg 400 comprises a pair of stops 410 that project from substantially opposing sides of the outer surface of the bipod leg 400, as shown in FIG. 3*b*, and each bore 330*a* comprises a pair of corresponding terminal stops to engage with the leg stops 410 when the legs are fully extended. The terminal stop(s) may be of any suitable configuration to abut against the leg stop(s) 410 and prevent the legs 400 from being removed from the tip 320. For example, a leg stop 410 that comprises a projection may engage with a terminal stop comprising an abutment surface in the form of an inner wall, projection, the edge of an opening, or the inner surface of a recess provided in the respective bore 330 within which the leg 400 is housed.

Figure 18A:
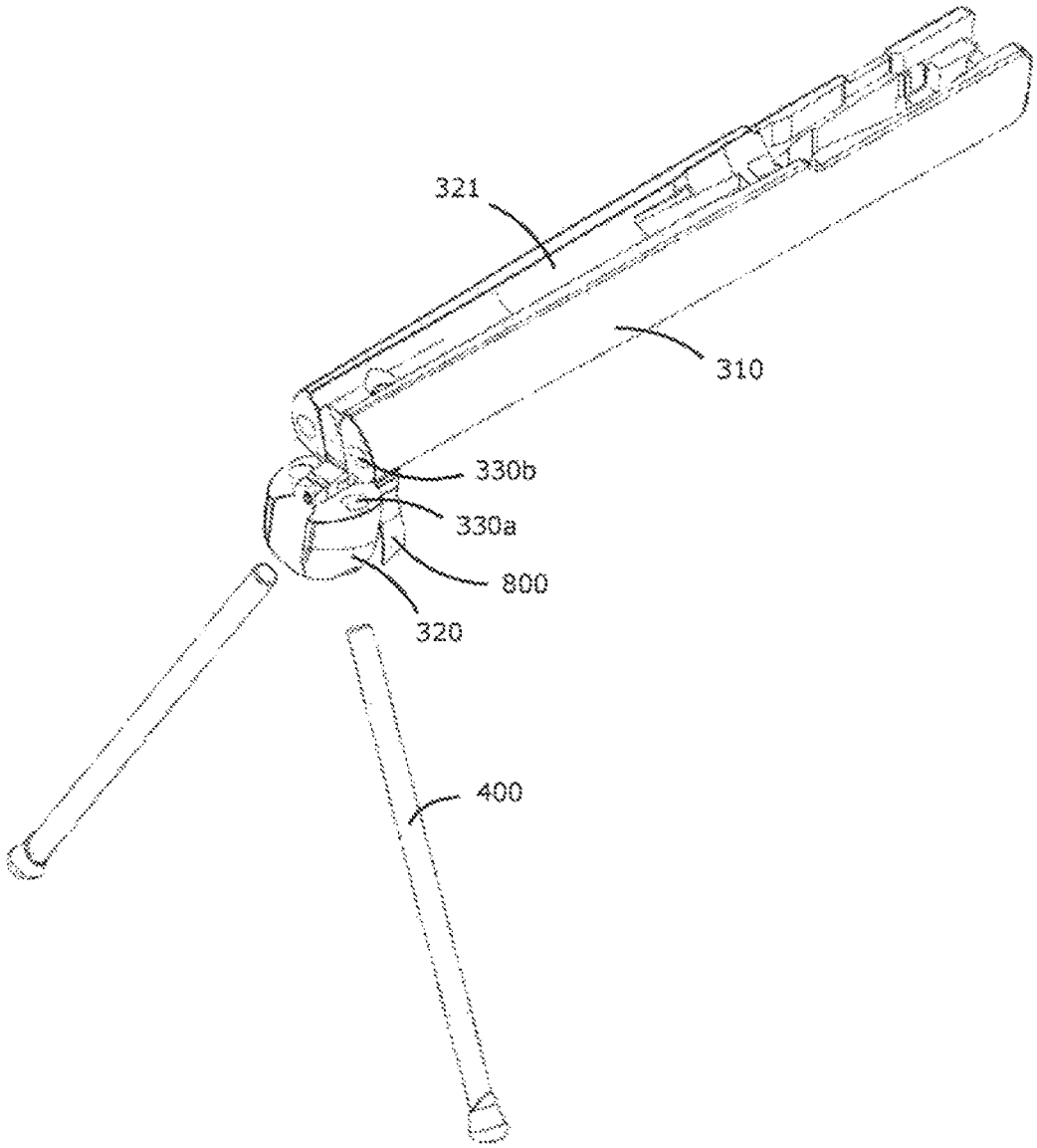
FIG. 18*a* is a partially exploded perspective view of another form of two part forestock in which the bipod legs are completely removable from the bipod housing.
Figure 18B:
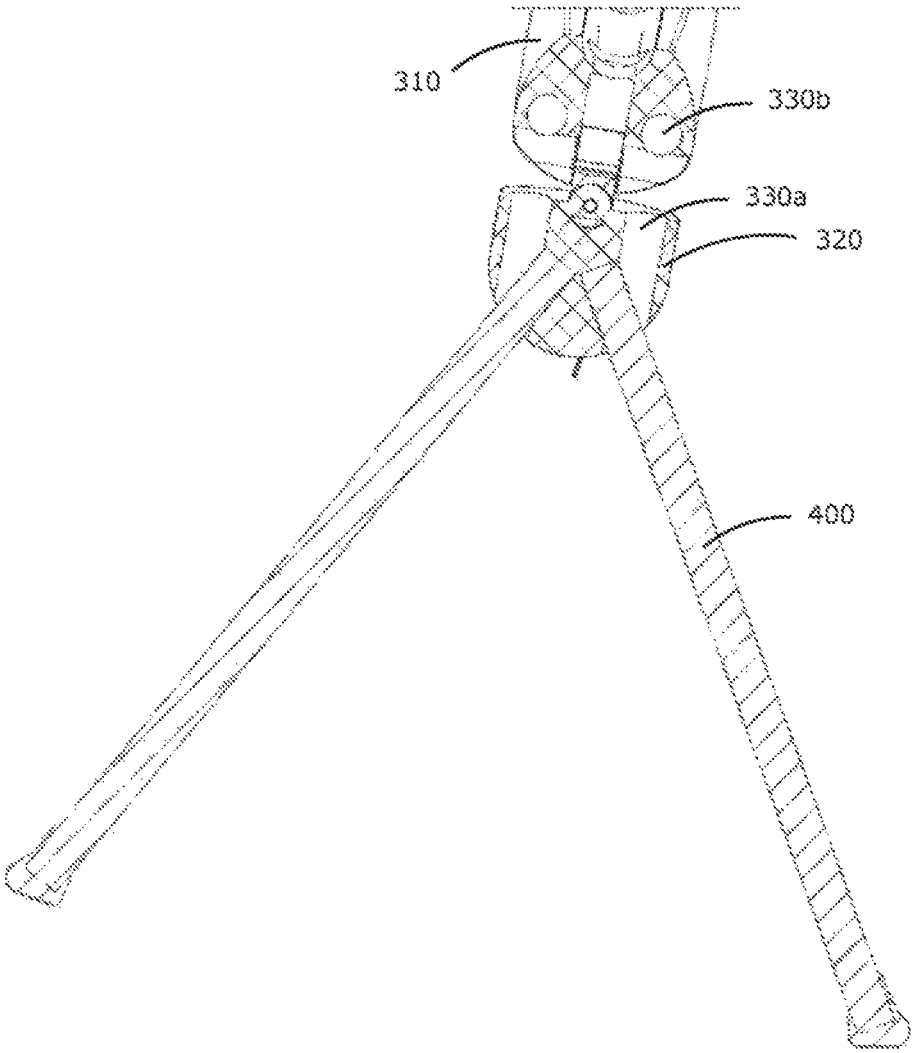
FIG. 18*b* is a cross-sectional side view of the forestock taken along line N-N of FIG. 18*a.*

In another form, as shown in FIGS. 18*a* and 18*b*, the bipod legs may be fully removable from the bipod housing.

In one form, each leg 400 may comprise a guide 411 to guide the legs 400 within the bores 330 of the bipod housing and prevent the legs 400 from rotating within the bores 330. Each guide 411 may project from the outer surface of the bipod leg 400 and may be configured to engage with a guide member 331 in the respective bore 330 in which the leg 400 is housed. In one form, one or more leg stops 410 of each bipod leg may each form a guide 411, as shown in FIG. 3*b*.

In one form, each bore 330 comprises a guide member 331 that substantially extends along at least a portion of the length of the bore and is configured to engage with the guide 411 of the respective bipod leg 400. In one form, the guide member 331 forms a channel that substantially extends along at least a portion of the length of the bore and that is configured to receive the guide 411. In this configuration, the guide 411 can slide along the guide channel 331 as though sliding along a track within the respective bore 330. The guide 411 remains within the channel 331 as the bipod leg 400 is Slid along the bore 330.

In one form, the bipod housing may comprise a pair of legs 400 and a pair of bores 330, one bore for each bipod leg 400. Each bore may comprise a pair of guide channels 331, one on the upper hemisphere and one on the lower hemisphere of the bore 330, as shown in FIG. 4*b*, so that the upper channel 331*a* lies substantially above the lower channel 331*b*. In this form, a bipod leg 400 may comprise a pair of substantially opposing projecting guides 411 to slide along the respective upper and lower guide channels 331*a*, 331*b* as the bipod leg retracts into or extends from the bore 330. In another form, each bipod leg may comprise only a single guide to engage with a single guide channel.

In one form, the guide channel 331 terminates before the open end of the bore 330. An end surface of the guide channel 331 may form a terminal stop configured to abut a leg stop 410 of the bipod leg when the leg 400 is fully extended from the tip 320. In the extended position, the leg stop 410 of a bipod leg 400 presses against the terminal stop of the guide channel 331 to prevent the leg 400 from being completely removed from the bipod housing.

In another form, the guide of each bipod leg may instead comprise a channel that extends partially along the length of the bipod leg 400 and terminates near the proximal end of the leg 400 to form an end surface. The end surface may form a leg stop at the proximal end of the bipod leg 400. A guide member comprising a projection may project into the bore 330 near the distal end of the tip 320. The guide member may be configured to be received within the channel of the leg and may slide within the channel as the leg is slid in and out of the bore 330. In this arrangement, the leg is prevented from rotating within the bore. In this configuration, the guide may also form a leg stop and the guide member may form a terminal stop. For example, when the leg 400 is fully extended from the tip 320, the end surface of the guide channel running along the leg abuts against the projecting guide member in the bore to prevent the leg from being removed from the bipod housing.

In one form, the bipod may be configured such that the bipod legs 400 are caused to splay apart from each other to provide a wider base with which to support the rifle. By splaying the legs apart, the stability of the bipod, and therefore of the rifle, is enhanced.

In one form, the bores 330 of the bipod housing may flare outwardly at the distal end of the tip 320, as shown in FIG. 4*f*. In this arrangement, when the bipod legs 400 are fully extended, the distal ends 402 of the legs 400 may be caused to splay outwardly to provide a wider base with which to support the rifle. For example, the proximal ends 401 of the bipod legs 400 may be caused to move toward each other in order to splay the distal ends 402 of the legs 400 apart. In this arrangement, the inner hemisphere of each bore 330 may comprise a bore recess 332, as shown in FIG. 4*f*, in which the proximal end 401 of the respective bipod leg 400 may be located when the legs 400 are in a splayed position. The bore recess 332 may comprise a brace 333 that acts as a backstop against which the proximal end of the respective bipod leg 400 may press when the bipod is supporting the rifle 100. An inner wall 335 of the bore recess and an outer wall 336 of the bore opening provide sloping guide surfaces that help guide the leg 400 into position and provide leverage for the leg 400 to support the rifle 100. In this way, the bipod legs 400 can support the weight of the rifle 100 and are prevented from retracting into the bores of the bipod housing. Typically, the brace 333 is a wall or other supporting structure that may be provided at the rear of the bore recess 332. For example, the brace may be a rear wall of the bore recess. However, in other configurations the brace may be provided in other suitable regions of the bore recess, such as a central region or front region.

In one form, the distal end of each guide channel 331 may form an angle that extends rearward from one side of the guide channel and toward the longitudinal centre line of the stock. For example, the distal end of a guide channel may took similar to half of an arrowhead, as shown in FIG. 4*f*. The angled region of the channel 331 may form a locator bay 334 in which the leg stops 410 or guides 411 may be located when the bipod legs 400 are splayed apart. In one form, the locator bay 334 may project into the bore recess 332. The locator bays 334 of the adjacent bores 330 are configured to allow the bipod legs 400 to splay apart and to be pushed back against the brace 333, under the weight of the rifle, without interference from the leg stops 410 or guides 411.

In one form, the bipod legs 400 may comprise enlarged distal ends to provide additional support to the rifle, without the need for the legs 400 to splay apart. In yet another form, the bipod housing may comprise a single bore configured to receive a pair of bipod legs having enlarged distal ends, as described above. In yet another form the bipod housing may comprise a single bore configured to receive a single bipod leg having an enlarged or significantly flared distal end such that the leg can support the rifle and substantially prevent side to side wobble of the rifle. In yet another form, the bipod may comprise a single leg, housed within a single bore in the forestock, and having a body attached to a pair of lower supports extending from the distal end of the body. The lower supports may be configured to be placed side by side when the leg is stored within the bore or to splay apart when the leg is extended. In the extended position, the bipod leg with lower supports forms a shape similar to an inverted "Y". The lower supports may be biased to splay apart so that as the leg is retracted from the bipod housing the lower supports automatically splay apart once they are released from the housing. To return the leg to the housing, a user may hold the lower supports together and then push the leg into the bipod housing. Alternatively, the leg may comprise a releasable lock to hold the lower supports together. The lock may comprise a latch or tie or any other system of holding the Sower supports together. In another form, the bipod housing does not comprise a flared end and the bipod legs do not splay apart.

In one form, where the bipod comprises a pair of legs, the bipod may comprise a biasing system to splay the legs 400 apart when the legs are fully extended. For example, in one form, the biasing system may comprise one or more springs attached to one or both legs and the tip and configured to push or pull the legs apart into a splayed position. In another form, the biasing system may comprise at least one magnet and a magnetic surface. The magnetic surface may be any surface that will attract or repel a magnet. For example, the magnetic surface may be a second magnet or may be a steel or iron surface. For the sake of simplicity, both the magnet and magnetic surface will be referred to in this specification as magnets, but it should be appreciated that any magnetic connection described herein may be made by using two connecting magnets or by using a connecting magnet and a magnetic surface without departing from the scope of the invention.

Returning to the embodiment shown in FIGS. 4*a* to 4*f*, the proximal end 401 of each bipod leg 400 may comprise a magnet. Each magnet may be held within a recess 430 formed in the outer surface of the bipod leg 400, as shown in FIG. 3*c*. One or more magnets may also be provided within each bore 330*a* of the tip to magnetically connect with the magnets of the bipod legs 400.

In one form, at least one magnet may be provided on an inner region of the outer surface of each bipod leg 400 so that the magnets on each leg 400 substantially face toward each other. A magnet may also be provided within the tip 320 and on the waif of the inner hemisphere of each adjacent bore 330*a*.

In one form, a magnet may be located within a magnet housing provided in the central wall separating the adjacent bores. In this arrangement, the magnet may be configured so that at least a portion of its magnetic surface forms part of the wall of the inner hemisphere of both bores. Alternatively, the inner hemisphere of each bore may comprise a magnet housing in which a magnet may be located.

The magnets within the bores 330*a* of the tip 320 are configured to attract the magnets on the bipod legs 400 to pull the proximal ends 401 of the legs 400 toward the centre line of the stock 300 and to cause the distal ends 402 of the bipod legs to splay outwardly.

In another form, magnets may be provided on the outer sides of the bipod legs 400 and on the wall at the outer hemisphere of the tip bores 330*a*. In this arrangement, the magnetic attraction between each leg 400 and the respective outer hemisphere wall of the bores 330*a* causes the legs to be pulled against flared outer walls of the bores 330*a* so that the legs 400 splay outwardly.

In yet another form, the biasing system may comprise tension members, such as springs or the like, that are held under compression within housings formed in the tip at the outer hemisphere walls of the bores. The tension members are configured to press against the outer sides of the bipod legs so that, when the legs are fully extended, the proximal ends of the legs are pushed into the bore recess 332 to splay the distal ends of the legs outwardly.

When the tip 320 is in the storage position, as shown in FIGS. 1, 10*a* to 10*d*, 14*a*, 14*b*, 16*a*, and 16*b*, the bipod legs 400 may be held within the bipod housing in a storage position or may be retracted from the housing to a fully extended position, in which the legs 400 project from the end of the tip 320 in a direction that is substantially parallel to the barrel 200 of the rifle. In this arrangement, the bipod legs are in a standard, extended position. To allow the bipod legs 400 to touch the ground and support the rifle 100 when in use, the tip 320 is configured to move from the storage position to the operational position, as shown in FIGS. 2, 11*a* to 12*b*, 14*c* to 14*e*, and 17*a* to 17*d*.

To allow the tip 320 to hinge from a first position to a second position, the rifle 100 comprises a connection system that attaches the tip 320 to the body 310 of the forestock. The connection system comprises a pivot member comprising a first rotational member configured to rotate about a first axis to allow the tip to hinge downwardly. The connection system also comprises a first pivot shaft having a longitudinal axis that defines the first axis extending in a first direction and about which the first rotational member can rotate.

The pivot member may optionally also comprise a second rotational member configured to rotate about a second axis to allow the tip to move from side to side with respect to the forestock body. The second axis may be substantially orthogonal to the first axis. In this form, the connection system also comprises a second pivot shaft having a longitudinal axis that defines the second axis extending in a second direction and about which the second rotational member can rotate. The first and second pivot shafts may be attached to the stock. In one form, the first pivot shaft is attached to the body 310 of the forestock and the second pivot shaft is attached to the tip 320.

Figure 6A:
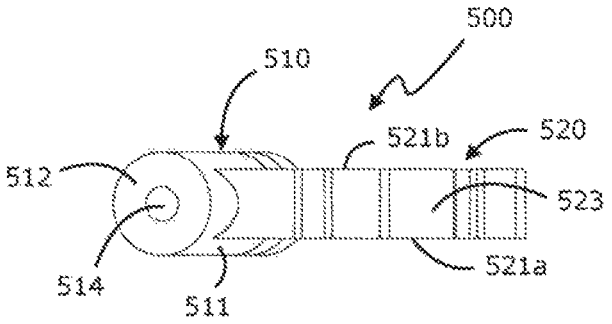
FIG. 6*a* is a top view of one form of pivot member to be used in a two part forestock according to the invention.
Figure 6B:
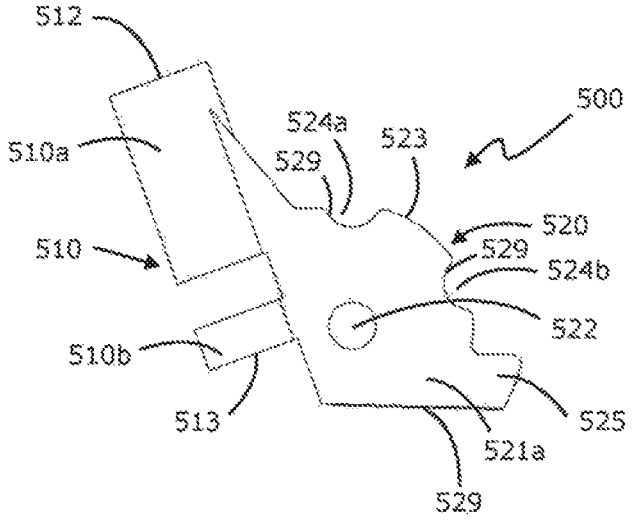
FIG. 6*b* is a side view of the pivot member of FIG. 6*a;*
Figure 6C:
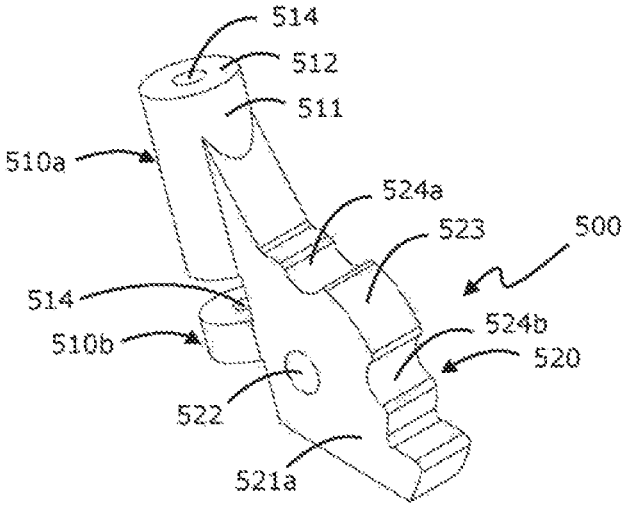
FIG. 6*c* is a perspective view of the pivot member of FIG. 6*a;*
Figure 6D:
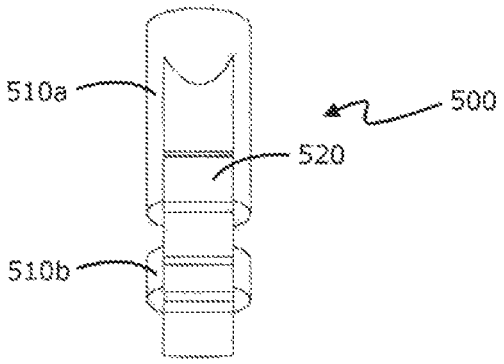
FIG. 6*d* is an end view of the pivot member of FIG. 6*a;*

FIGS. 6*a* to 6*b* show various forms of pivot member 500. The pivot member 500 is housed within a pivot member cavity 315*a*, as shown best in FIGS. 9*a* and 9*b*. The pivot member 500 connects the forestock body 310 to the tip 320. In the form illustrated, the pivot member comprises both a first rotational member and a second rotation member to allow the pivot member to rotate about both a first axis and a second axis. The first rotational member of the pivot member 500 comprises an angle adjuster 520 and the second rotational member comprises a sleeve 510. The angle adjuster 520 comprises a first bore 522 for receiving a first pivot shaft therein and the sleeve 510 comprises a second bore 514 for receiving a second pivot shaft therein.

The angle adjuster 520 may be attached to or integrally formed with the sleeve and is configured to adjust the angle of the tip 320 relative to the forestock 300. The angle adjuster may also be configured to engage with a lock to lock the angle of the tip in a desired position. Where the pivot member does not include a second rotational member to allow the tip to move from side to side, the angle adjuster may comprise a mount by which to fixedly attach the angle adjuster to the tip. In another form, the angle adjuster may be integrally formed with the tip.

In one form, the sleeve 510 may comprise a ring-like structure. In another form, as shown in FIGS. 6*a* to 8*b*, the sleeve 510 may comprise a substantially elongate cylindrical structure. The sleeve 510 may comprise an outer surface 511, a first end 512, a substantially opposing second end 513, and a sleeve bore 514 (forming the second bore of the pivot member) extending along the length of the sleeve 510. Where the sleeve is substantially cylindrical, the sleeve bore 514 may extend longitudinally within the sleeve 510. Preferably, the bore 514 is centrally located within the sleeve 510. Optionally, the cylindrical sleeve 510 may be formed in two parts, a first part 510*a* and a second part 510*b*, spaced at a distance from the first part. In another form, the sleeve may be formed in three or more parts. The sleeve parts are substantially aligned so that the sleeve bore may substantially extend along the centre line of each part of the sleeve.

The tip 320 may also comprise a sleeve support 325 configured to receive the sleeve 510 of the pivot member 500. The sleeve support 325 may comprise one or more brackets to which the sleeve 510 is attached.

In one form, the sleeve support comprises a single bracket comprising at least one spigot configured to project into the bore 514 of the sleeve, so that the sleeve may rotate about the spigot. Preferably, the sleeve support comprises two brackets located at each end of the sleeve. A spigot may be provided on each end bracket and may be configured to be received within the ends of the sleeve bore 514. The spigot(s) form a sleeve pivot shaft (forming the second pivot shaft of the pivot member) about which the tip 320 can rotate from side to side to some extent.

In another form, as shown in FIGS. 4*c* and 4*f*, the sleeve support 325 may comprise at least two brackets 325*a*, 325*b* and the sleeve may be configured to be located between the brackets. Each end bracket may comprise a pin aperture 326 configured to substantially align with the sleeve bore 514. An axial pin forms a sleeve pivot shaft 550 and extends through the bore 514 of the sleeve and through the pin apertures 326 of the end brackets. The pin may be held in place by any suitable fastening system that prevents the pin from retracting from the pin apertures 326 and sleeve 510, whilst allowing the sleeve to rotate about the pin. For example, the pin may comprise a nut and bolt arrangement. In this form, the tip 320 is able to rotate about the axis formed by the sleeve pivot shaft 550 so that the tip can swivel from side to side to allow the bipod legs to support the rifle on an uneven surface.

Where the sleeve 510 comprises two parts, as described above and as illustrated in FIGS. 6*a* to 8*b*, the sleeve support 325 may comprise two end brackets 325*a*, 325*b* and a middle bracket 325*c*, located between the end brackets 325*a*, 325*b*. The brackets 325 may be configured to provide a sleeve/second pivot shaft in the form of a spigot, as stated above, or to comprise a pin aperture so that a second pivot shaft in the form of a pin may extend through the pin apertures and sleeve to allow the sleeve to rotate about the sleeve pivot shaft. Although it is not essential for the sleeve to be formed in two parts, it helps to provide both the bracket 500 and tip 320 with additional robustness and strength.

Figure 5C:
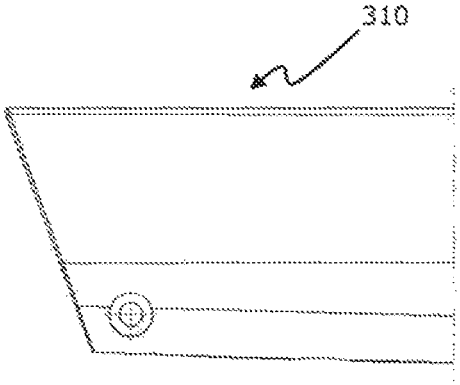
FIG. 5*c* is a side view of the forestock body of FIG. 5*a;*

In a preferred form, the sleeve support 325 is provided on a proximal end surface of the tip 320, which is sloped in a rearward direction from the upper surface of the tip to its lower surface, as shown in FIG. 4*e*. The distal end surface of the forestock body 310 may comprise a correspondingly sloped surface, as shown in FIG. 5*c*, so that the two end surfaces of the tip and forestock body lie substantially flush with each other when the tip is in the standard position.

The angle adjuster 520 of the pivot member 500 may project from the outside surface of the sleeve 510, as shown in FIGS. 6*a* to 8*b*.

In one form, the angle adjuster 520 comprises a pair of substantially opposing first and second surfaces 521*a*, 521*b* and an angle adjuster bore 522 (forming the first bore of the pivot member) that extends through the angle adjuster from the first face 521*a* to the second face 521*b* in a direction that is substantially orthogonal to the direction of the sleeve/second bore 514 formed in the sleeve 510. The first pivot shaft 560 of the connection system may engage with the body 310 of the forestock and pass through the first bore 522 of the pivot member 500 so that the pivot member is also able to rotate about the longitudinal axis of the first pivot shaft 560. In this arrangement, the tip is able to hinge downwardly away from the barrel 200 of the rifle 100 by pivoting about the first pivot shaft 560.

The angle adjuster also comprises a first side surface from which the sleeve or mount projects, and a second side surface that extends from one end of the sleeve to the other end of the sleeve and that forms a locking surface. The side surfaces extend between the first and second faces 521*a*, 521*b* of the pivot member 500. The angle adjuster may also comprise a projecting foot 525 configured to engage with an obstruction in the pivot member cavity 315*a* to prevent the pivot member from rotating beyond a maximum point.

In one form, the angle adjuster comprises a substantially planar body.

In one form, the sleeve is provided at one end of the angle adjuster and the locking surface 523 is provided at the other end. At least a portion of the locking surface may be substantially arcuate.

The locking surface 523 may comprise one or more locking elements 570 configured to engage with a lock to lock the angle at which the tip 320 tilts relative to the forestock body 310.

Figure 7A:
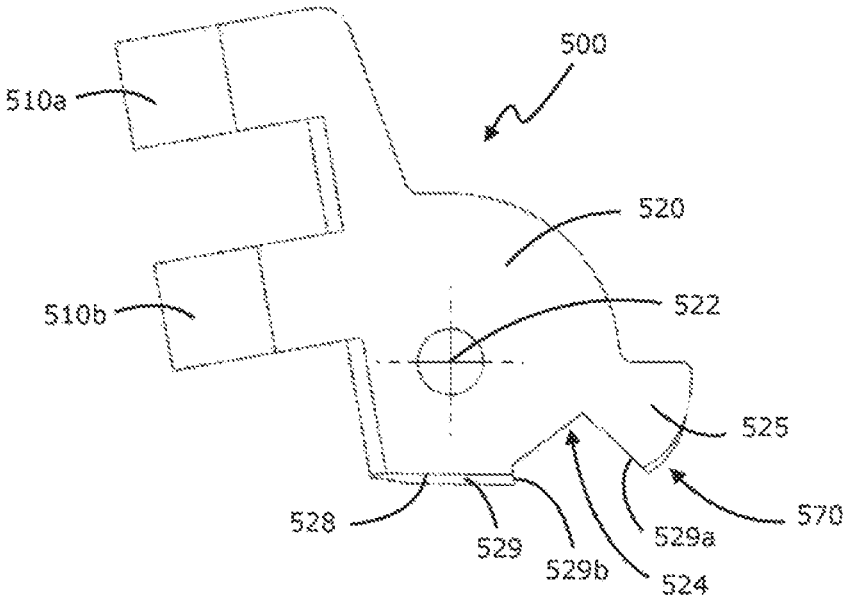
FIG. 7*a* is a perspective view of another form of pivot member to be used in a two part forestock according to the invention.
Figure 7B:
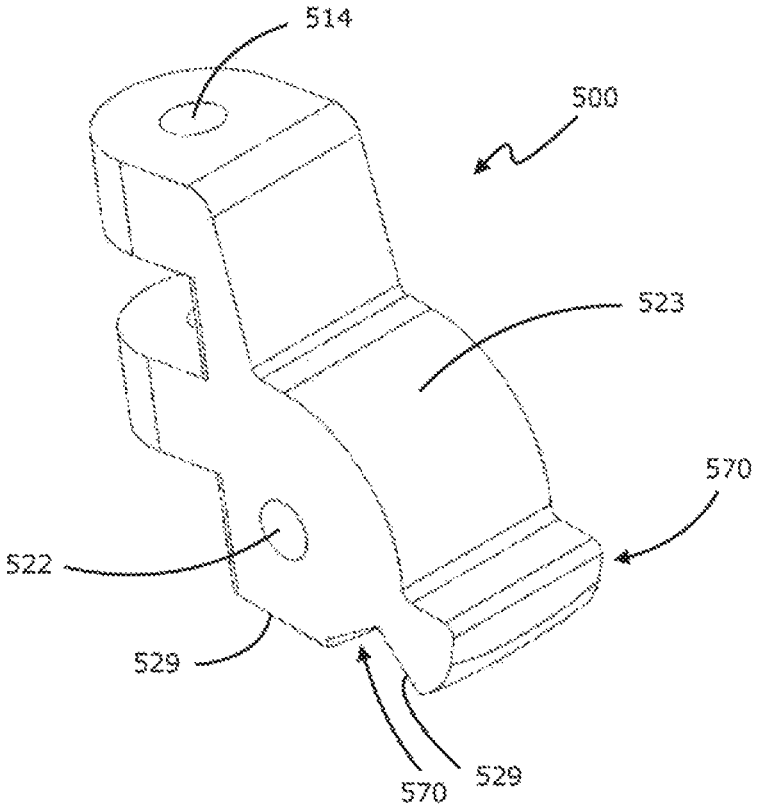
FIG. 7*b* is another perspective view of the pivot member of FIG. 7*a;*
Figure 8A:
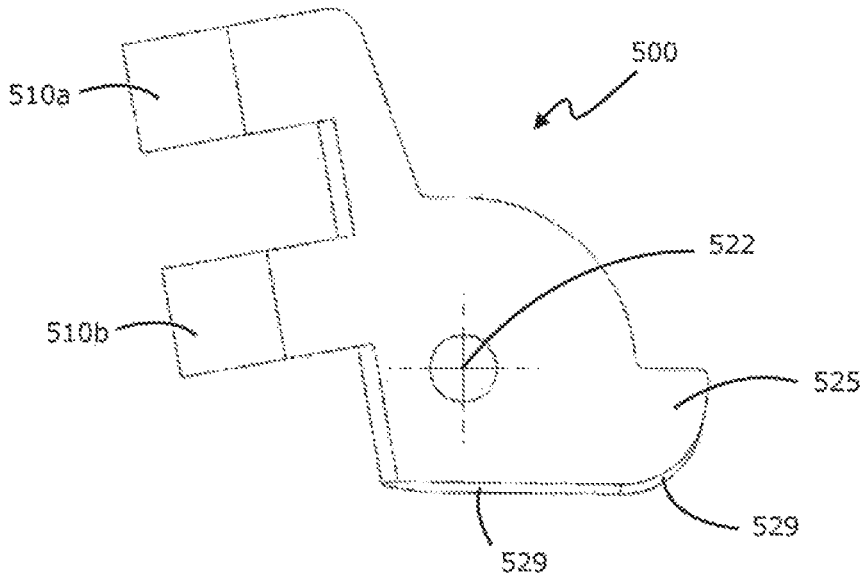
FIG. 8*a* is a perspective view of yet another form of pivot member to be used in a two part forestock according to the invention.
Figure 8B:
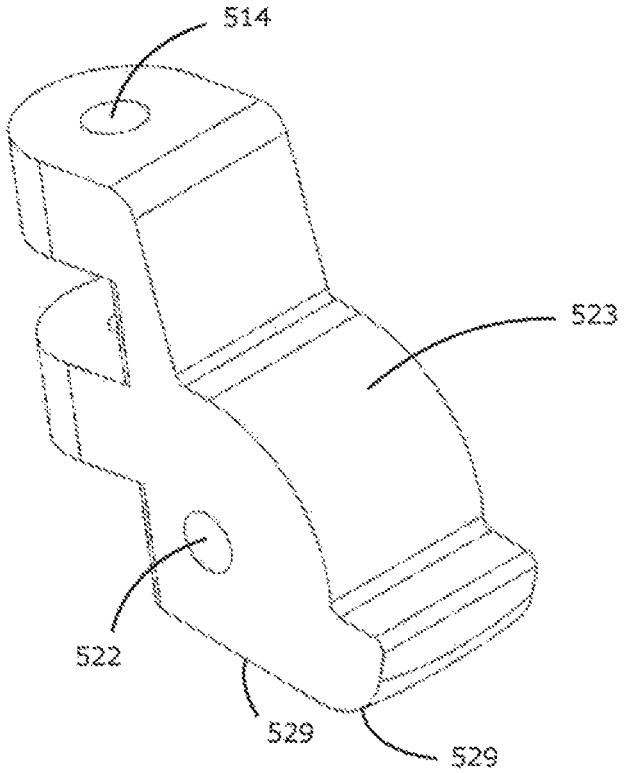
FIG. 8*b* is another perspective view of the pivot member of FIG. 8*a;*

Each locking element 570 may comprise a recess 524, aperture, projection 525, wall 528 or the tike that comprises an abutment surface 529 configured to press against the lock when the tip is in the locked position to prevent further rotation of the angle adjuster about the first axis. The abutment surface 529 may be a side surface of a recess formed in the angle adjuster, a side edge of an aperture formed in the angle adjuster or a side surface of a projection projecting from the locking surface of the angle adjuster, as shown in FIGS. 6*a* to 8*b*. For example, as shown in FIGS. 7*a* and 7*b*, the locking surface comprises a projecting foot 525 having a lower surface. A recess 524 is formed beneath the foot 525 and is shaped to receive the distal end of the locking arm. The lower surface of the foot 525 forms one side wall of the recess. The recess also comprises an opposing side wall. Both side walls of the recess form abutment surfaces 529*a*, 529*b* that hold the locking arm 620 in the recess 524 and prevent rotation of the pivot member 500.

In another form, as shown in FIGS. 7*a* to 8*b*, a waif at the lower region of the locking surface, such as at the base of the angle adjuster, may form an abutment surface 529*c*. In this form, the pivot member can be rotated to cause the tip 320 to hinge downwardly until the pivot member reaches a maximum point of rotation. The lock may then be caused to press against the lower wall/surface of the angle adjuster to prevent the pivot member from rotating and therefore to lock the tip in position.

In the pivot member configuration shown in FIGS. 6*a* to 6*d*, 7*a*, and 7*b*, the locking surface comprises at least two locking elements so that the tip may be locked at different hinged positions to allow a user to increase or decrease the angle at which the rifle is supported by the bipod.

Although the angle adjuster has been described and shown as being attached to the forestock body and the sleeve has been described and shown as being attached to the tip, it is envisaged that in some forms, the reverse arrangement may also be used. For example, the angle adjuster may be attached to the tip and the sleeve may be attached to the forestock body.

The bipod connection system may also comprise a lock to lock the tip 320 in a desired angular position relative to the forestock.

The lock may be configured to engage with the forestock and the pivot member 500 to lock the tip in position with respect to the forestock body. In one form, the forestock lock comprises a locking member 340 configured to engage with the angle adjuster 520 to lock the tip at a desired angular position with respect to the forestock body 310, and to disengage from the angle adjuster to allow the tip 320 to move from a first position to a second position. The lock may be housed within the forestock body or the tip.

Figure 9A:
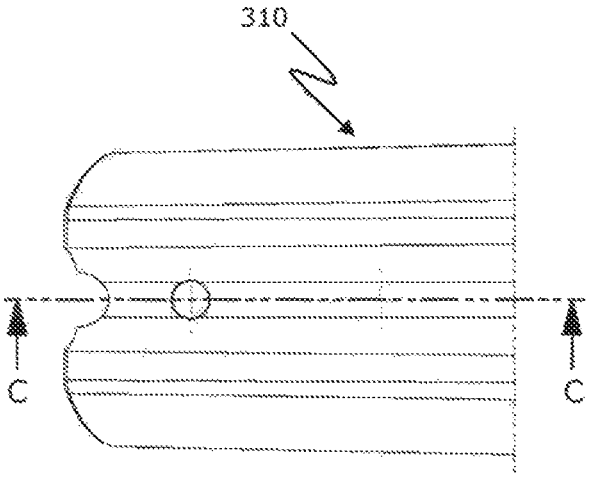
FIG. 9*a* is a top view of one form of forestock body according to one form of the invention.
Figure 9B:
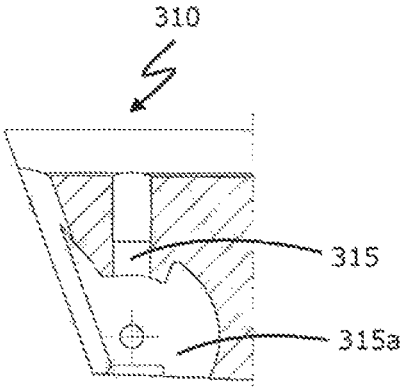
FIG. 9*b* is a cross sectional side view of a portion of the forestock body taken along line C-C of FIG. 9*a;*
Figure 10A:
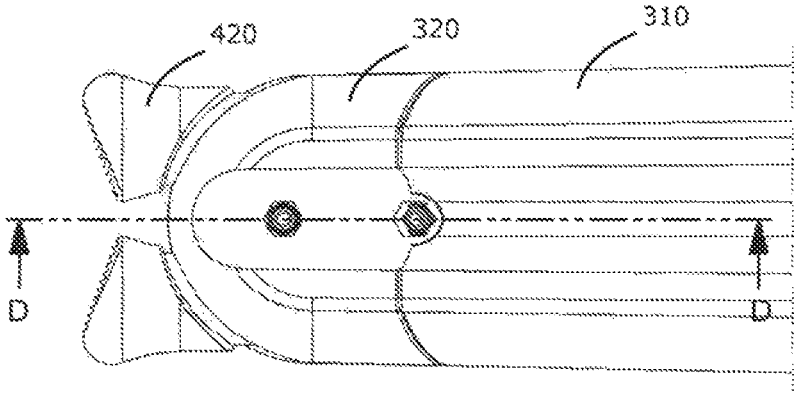
FIG. 10*a* is a top view of a portion of a forestock according to one form of the invention.
Figure 10B:
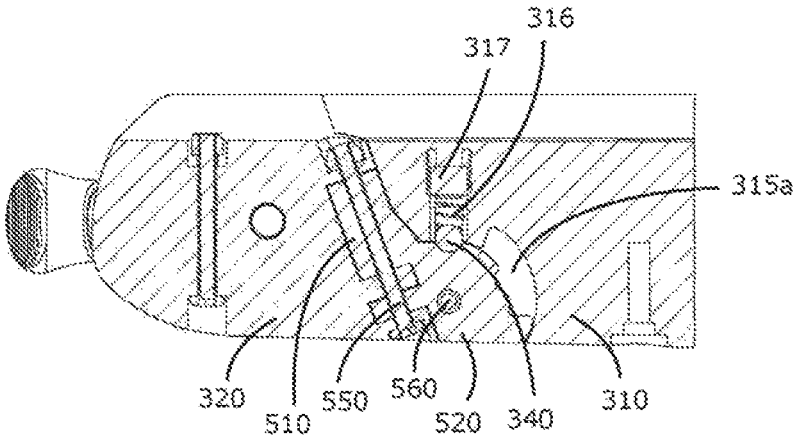
FIG. 10*b* is a cross-sectional side view taken along line D-D of the forestock shown in FIG. 10*a;*
Figure 10C:
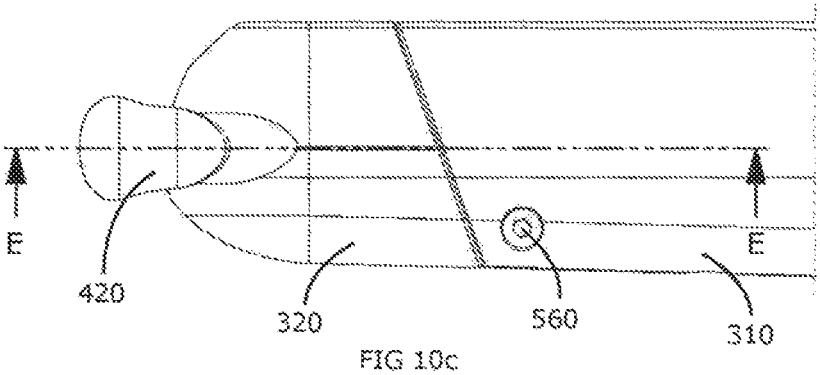
FIG. 10*c* is a side view of a portion of a forestock according to one form of the invention.
Figure 10D:
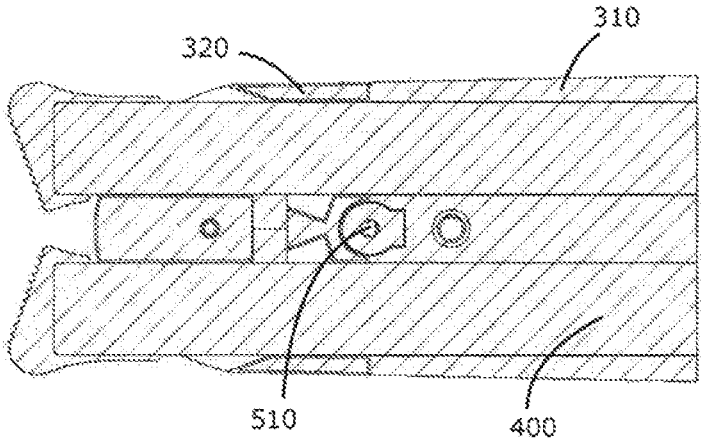
FIG. 10*d* is a cross-sectional top view taken along line E-E of the forestock shown in FIG. 10*c;*
Figure 11A:
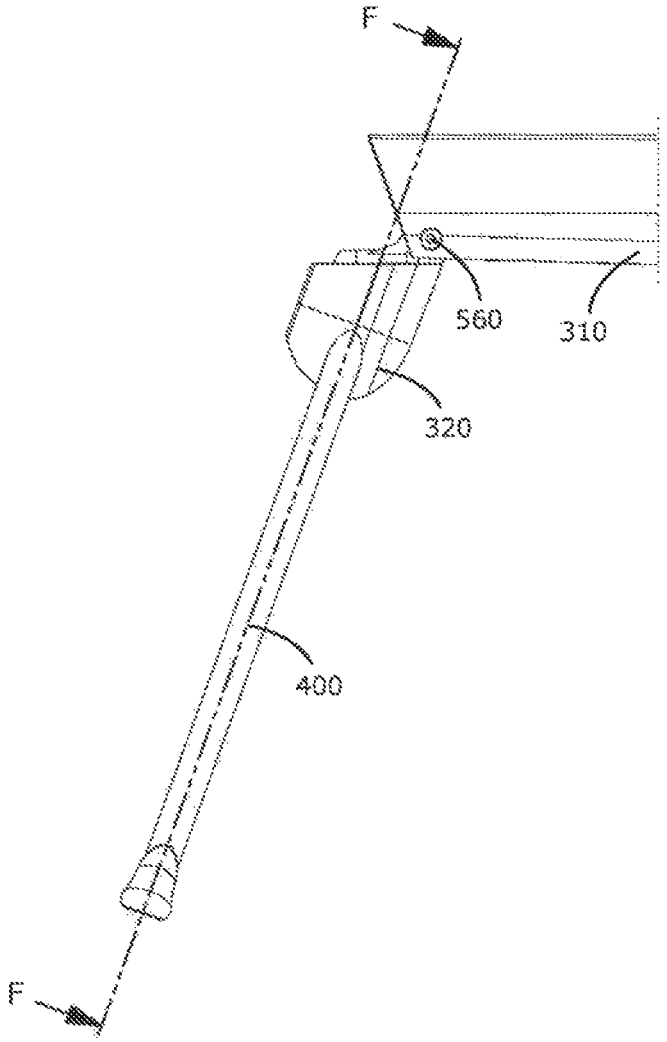
FIG. 11*a* is a side view of one form of forestock and bipod in an operational position.
Figure 11B:
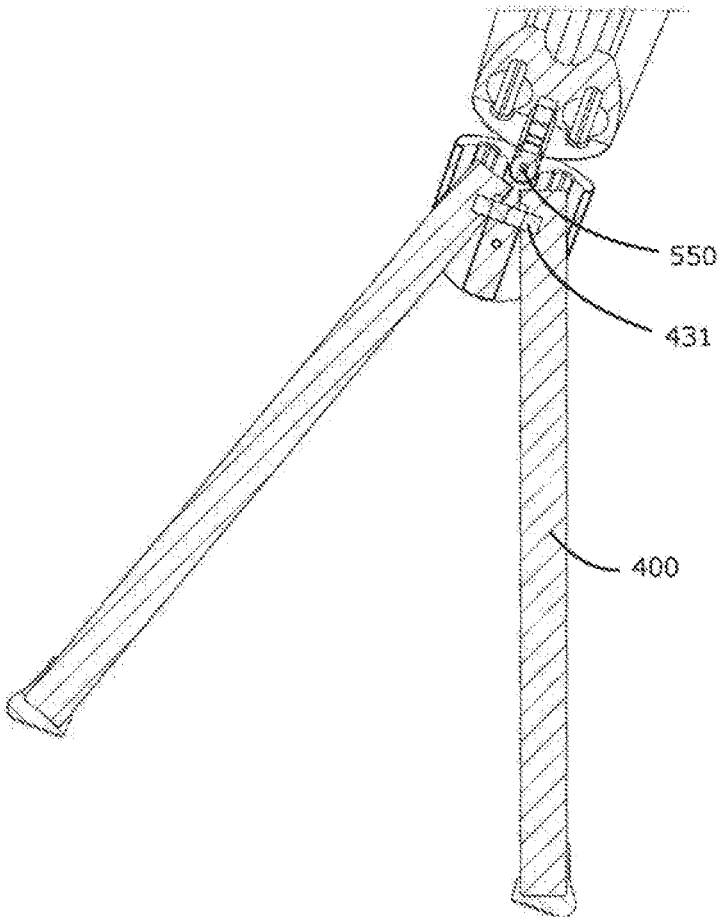
FIG. 11*b* is a cross-sectional view taken along line F-F of FIG. 11*a;*
Figure 12A:
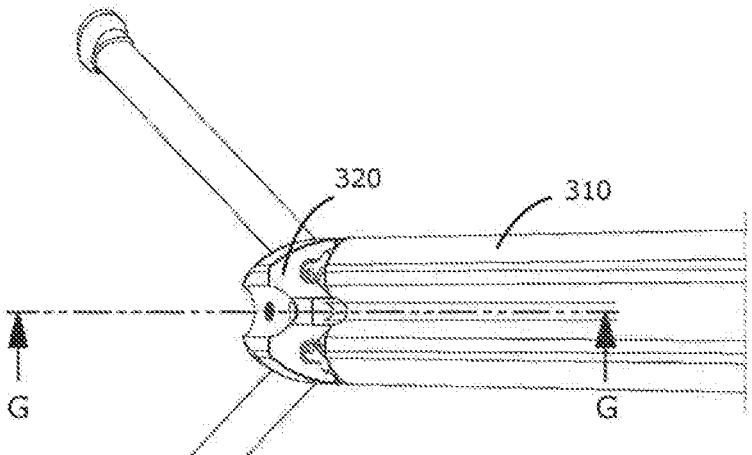
FIG. 12*a* is a top view of one form of forestock and bipod in an operational position.
Figure 12B:
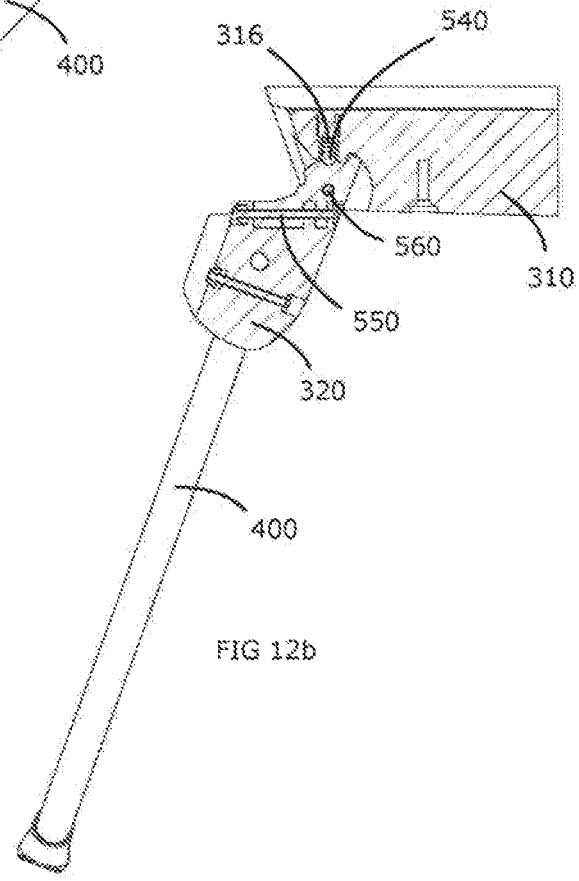
FIG. 12*b* is a cross-sectional side view taken along line G-G of FIG. 12*a;*

In one form, the lock is housed in a first lock housing 315 within the forestock body 310, as shown in FIG. 9*b* forestock. The pivot member 500 is housed in an adjacent cavity 315*a* that opens to the first lock housing 315 so that a locking member can project from the lock housing and into the cavity 315*a*. The locking member 340 may be configured to engage with at least one locking element 570 of the angle adjuster 520. For example, the locking member 340 may comprise a projection that projects into the first locking region 315*a* to engage with at least one locking element. The locking element may comprise a recess, aperture, projection, wall or the like that comprises an abutment surface that presses against the locking member 340 when the tip is in the locked position. The abutment surface may be a side surface of a recess formed in the angle adjuster, a side edge of an aperture formed in the angle adjuster or a side surface of a projection projecting from the locking surface of the angle adjuster. In another form, the abutment surface may be a lower region of the locking surface, such as a region at the base of the angle adjuster. Alternatively, the locking member may comprise an aperture or recess and the locking element may comprise a projection extending from the locking surface 523 of the angle adjuster and configured to be received within the locking member to lock the position of the angle adjuster 520 (and therefore the tip 320) relative to the forestock body 310.

The locking member 340 may also be configured to retract, rotate away from, or otherwise disengage from a locking element of the angle adjuster so that the tip 320 is unlocked and able to hinge about the body 310 of the forestock.

In one form, as shown in FIGS. 10*b*, 12*b*, 14*b*, and 14*e*, the lock is a compressive lock that is biased to a locking position in which the locking member 340 is pushed into the first locking region 315*a* under a biasing force from a biasing member 316. The biasing member 316 may comprise a spring or any other compressible material held under compression within the second locking region 315*b*. The biasing member pushes against the locking member 340, which may comprise a ball for example, so that the locking member presses against the locking surface of the angle adjuster 520. In this arrangement, as the tip 320 is hinged away from the body 310 of the forestock, the locking member 340 will push into a recessed locking element, such as a lock receiving aperture or recess 524, on the locking surface 523 when the locking element aligns with the locking member 340 to lock the tip 320 in position. In some forms, two or more locking elements 524 may be provided on the locking surface 523 of the angle adjuster 520 so that the tip 320 can be locked in a variety of different angles relative to the forestock body 310. In this form, a user may continue to pull the tip 320 downward and away from the forestock body to hinge the tip from the forestock body 310. The locking member 340 may be configured to release its engagement with a first locking element 524*a* as the user overcomes the compression force of the biasing member 316 by pushing or pulling the tip 320 sufficiently firmly in the desired direction, which forces the angle adjuster 520 to rotate about the second pivot shaft. As the angle adjuster 520 rotates, the locking member 340 continues to press against the locking surface 523 until the locking member 340 aligns with a second locking element 524*b*, at which point the locking member 340 engages with the second locking element. The process may continue if the angle adjuster 520 comprises more than two locking elements 524 and the user wishes to increase the angle at which the tip 320 tilts relative to the forestock body 310.

The locking member 340 may be retractable to disengage the locking member from the locking element 524. For example, the biasing member 316 may comprise a release system 317 by which the compressive force of the biasing member may be released to allow the tip 320 to pivot freely about the second pivot shaft. Referring to FIGS. 10*a* to 12*b*, in use, the bipod legs 400 may be pulled out of the bipod housing by sliding the legs along the bores 330 until the leg stops 410 engage with the terminal stops of the guide channels 331. The magnets 431 cause the proximal ends 401 of the legs 400 to move toward each other and into the bore recesses 332. The distal ends 402 of the bipod legs 400 are therefore caused to splay apart. The tip 320 may then be hinged to an operational position in which the bipod legs 400 extend downwardly so that the feet 420 of the legs rest on the ground or other supporting surface. As the tip 320 is pulled into the operational position, the Socking member 340 projects into an aligned locking element 524 to lock the tip 320 in position relative to the body 310 of the forestock. As the rifle rests on the bipod legs 400, the proximal ends 401 of the legs are caused to push against the brace 333 of the respective bore recess 332 to hold the legs in position and to prevent automatic retraction of the legs 400 under the weight of the rifle. If the ground is uneven, the tip 320 may be pivoted from side to side about the first pivot shaft 550 to stabilise the rifle.

Figure 13A:
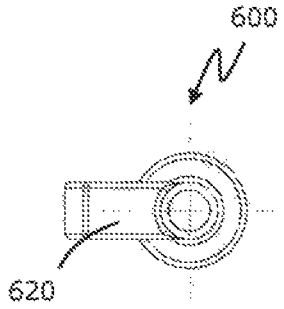
FIG. 13*a* is a top view of one form of lock for one form of locking system of the invention.
Figure 13B:
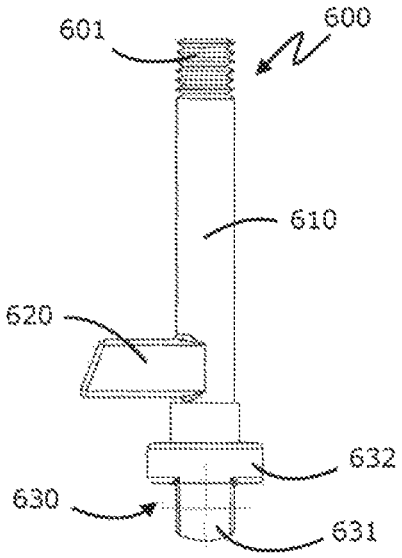
FIG. 13*b* is a side view of the lock of FIG. 13*a;*
Figure 13C:
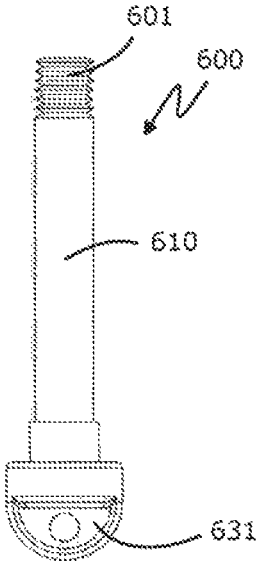
FIG. 13*c* is another side view of the lock of FIG. 13*a;*

In another form, as shown in FIGS. 13*a* to 13*c*, the rifle forestock may comprise a substantially non-compressive lock 600 configured to help prevent the biased locking member 340 from accidentally disengaging with the locking element 524 under a compressive force, which may cause the tip 320 to move from a deseed position. A non-compressive lock 600 may be particularly useful when the rifle is a high calibre rifle with significant recoil that may otherwise overcome the compressive force of the biasing member 316 described above and cause the locking member 340 to disengage with the locking element 524. FIGS. 14*a* to 14*e* illustrate one form of rifle having a substantially non-compressive lock 600 used in combination with the compressive Jock arrangement described above. FIGS. 15*a* to 16*f* illustrate a rifle comprising only one form of lock, that being a substantially non-compressive lock.

As shown in FIGS. 13*a* to 13*c*, the lock 600 comprises a lock body 610, a locking member in the form of a locking arm 620 that projects from the side of the lock body 610, and a gripping member 630 located at a first end of the body 610. The lock also comprises an attachment element 601 for attaching the lock to the forestock body 310 in such a way that the lock body is able to rotate about its longitudinal axis within a lock housing in the forestock body 310. Where the forestock also comprises a compressive lock, the compressive lock may be located in a first lock housing 315 and the non-compressive lock may be located in a second Sock housing 700.

In one form, the lock body 610 may comprise an elongate shaft, in a preferred form, the lock body has a generally cylindrical shape.

In one form, the attachment element 601 comprises a threaded region provided at a second end of the lock body 610. The threaded attachment element is configured to screw into a corresponding threaded bore provided in the forestock body 310. In one form, the threaded bore may be integrally formed in the forestock body 310 or the threaded bore may be formed in a nut or some other attachment that is attached to and held within the forestock body 310. In another form, the attachment element may comprise a flange configured to be pushed past a collar located within the lock housing 700 to prevent the lock from readily pulling out of the forestock body 310. Other forms of attachment element may also be suitable.

As the lock body 610 rotates within the lock housing 700, the locking arm 620 is also caused to rotate. The locking arm 620 may project from the lock body 610 at any suitable angle between 0° and 180° and preferably projects at an angle of approximately 90° to the body 610.

The lock housing 700 for the non-compressive lock may form an opening at a surface of the forestock through which the gripping member 630 may project. A user may manipulate the lock 600 to cause the locking arm 620 to rotate to the engage with the pivot member 500 in a locked position or disengage with the pivot member in an unlocked position by rotating the gripping member in a first direction and a second direction.

In one form, the gripping member 630 may comprise a loop 631*a* onto which a rifle strap may be attached, as shown in FIG. 13*c*. In this form, a tie of the rifle strap 800 may pass through a hole 231*b* in the loop 231*a* and tie onto the key 230, as shown in FIGS. 16*b* and 17*b*, for example.

In one form, the gripping member 630 may also comprise a collar 632 forestock dimensioned to be wider than the opening of lock housing 700. The collar 632 presses against a surface of the forestock body 310 when the attachment element engages with the forestock body 310 to hold the lock in place. Where the lock comprises a threaded end to screw into a threaded bore in the forestock body 310, the lock 600 may be readily removed from the forestock by rotating the gripping member 630 until the threaded end 601 of the lock body 610 disengages with the threaded bore of the forestock. Similarly, the lock 600 may be reinserted into the lock housing 700 by pushing the threaded end 601 of the lock through the opening of the lock housing 700 and rotating the gripping member 630 to cause the threaded end 601 of the lock 500 to engage with the threaded bore of the forestock.

The gripping member 630 may be configured to allow a user to readily identify whether or not the lock stop 600 is in the locked position. For example, when the gripping member 630 faces a first direction, such as to one side of the forestock body, the lock 600 may be in a locked position. Conversely, when the gripping member 630 faces a second direction, such as to the front of the forestock body, the lock 600 may be in an unlocked position.

Figure 14A:
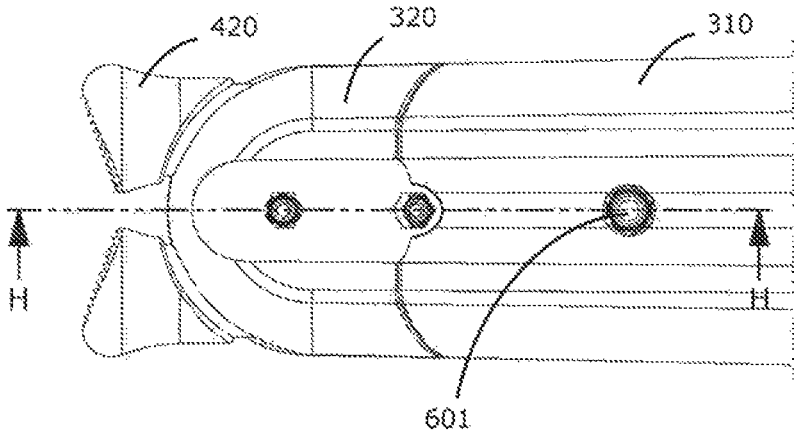
FIG. 14*a* is a top view of a portion of a forestock and bipod comprising a locking system with a compressive lock and a substantially non-compressive lock as shown in FIG. 13*a;*
Figure 14B:
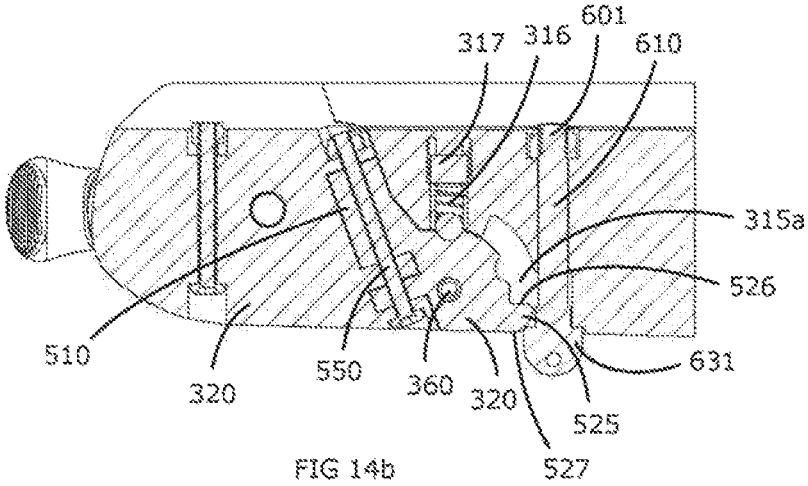
FIG. 14*b* is a cross-sectional side view taken along line H-H of FIG. 14*a* in which the non-compressive lock is in an unlocked position.
Figure 14C:
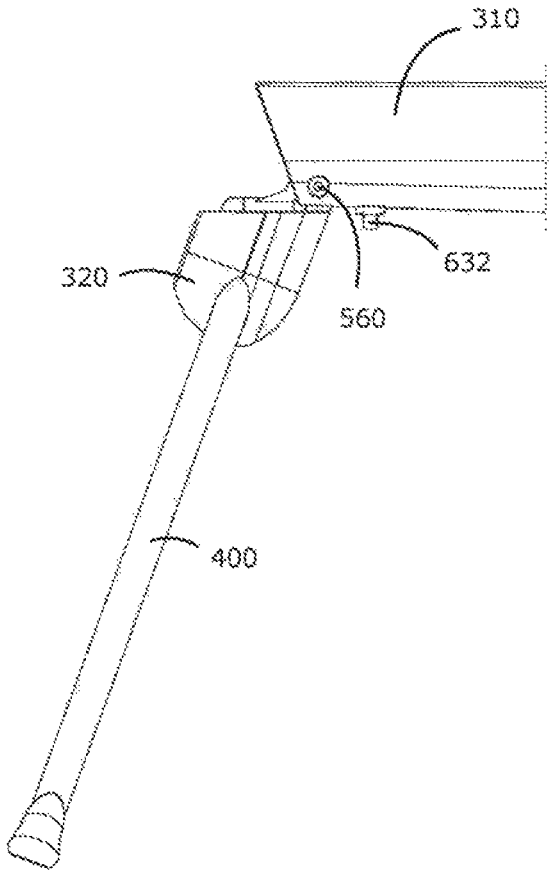
FIG. 14*c* is a side view of the forestock and bipod of FIG. 14*a* in an operational position.
Figure 14D:
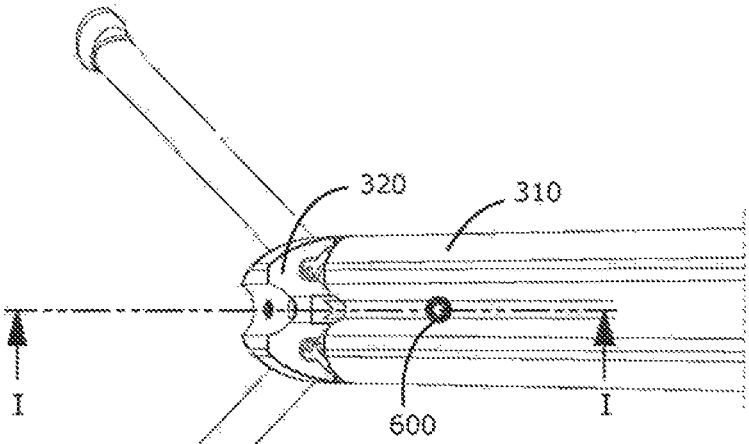
FIG. 14*d* is a top view of the forestock of FIG. 14*a;*
Figure 14E:
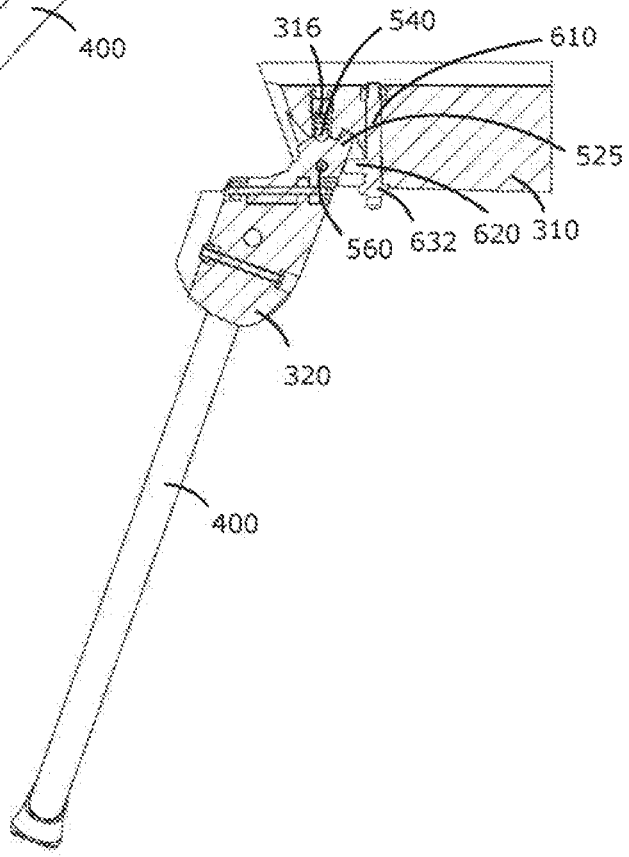
FIG. 14*e* is a cross-sectional side view taken along line I-I of FIG. 14*d* in which the non-compressive lock is in a locked position.
Figure 16A:
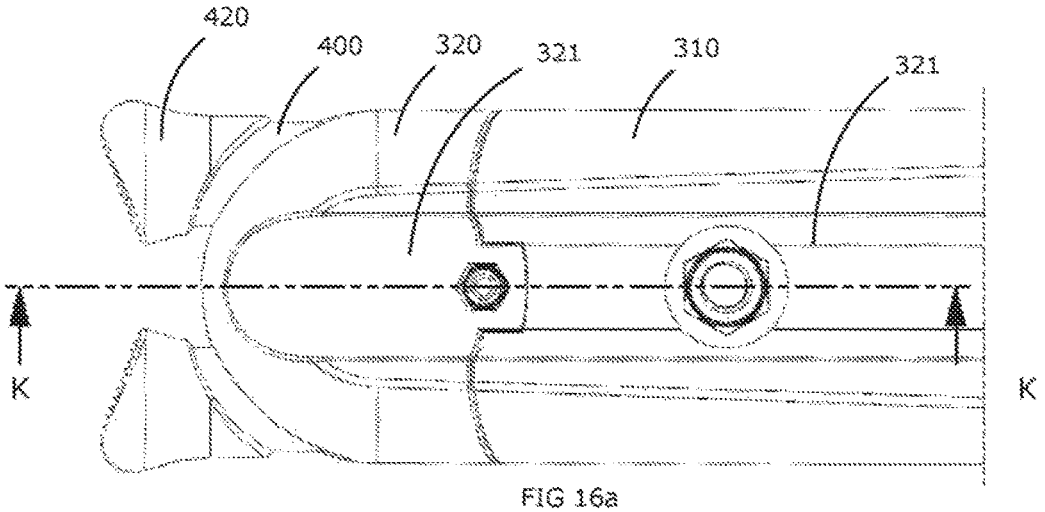
FIG. 16*a* is a top view of a distal end portion of a two part forestock according to one form of the invention.
Figure 16B:
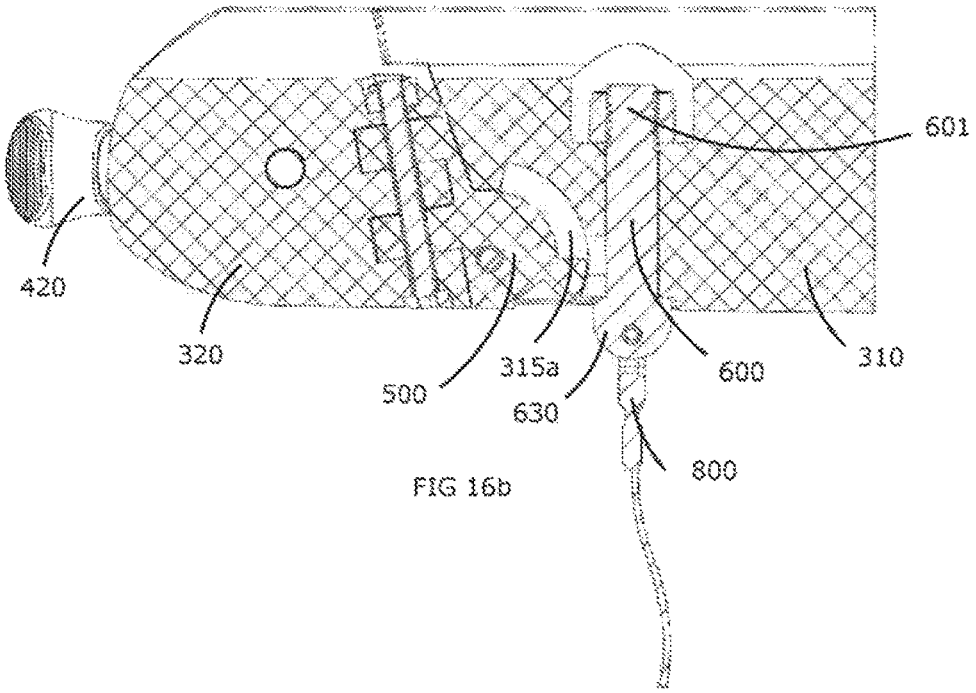
FIG. 16*b* is a cross-sectional side view of the forestock taken along line K-K of FIG. 16*a* and showing one form of pivot member and a substantially non-compressive lock in an unlocked position when the forestock tip and bipod are in a storage position.
Figure 17A:
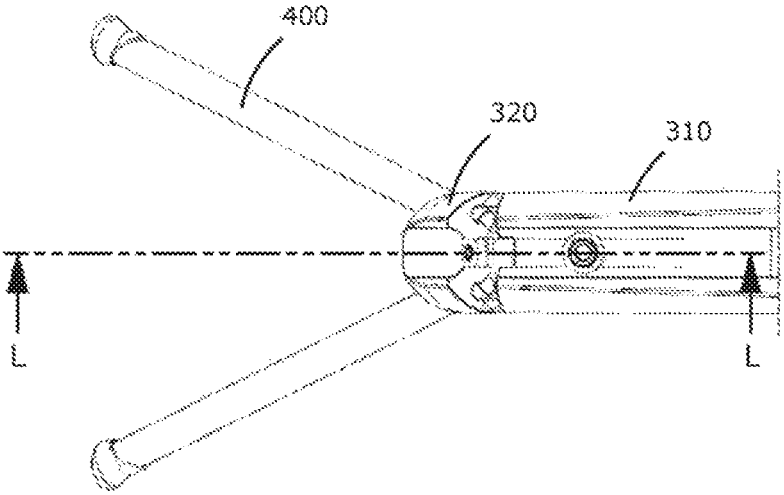
FIG. 17*a* is a top view of one form of two part forestock according to the invention, in which the tip and bipod legs are angled away from the forestock body in a first position.
Figure 17B:
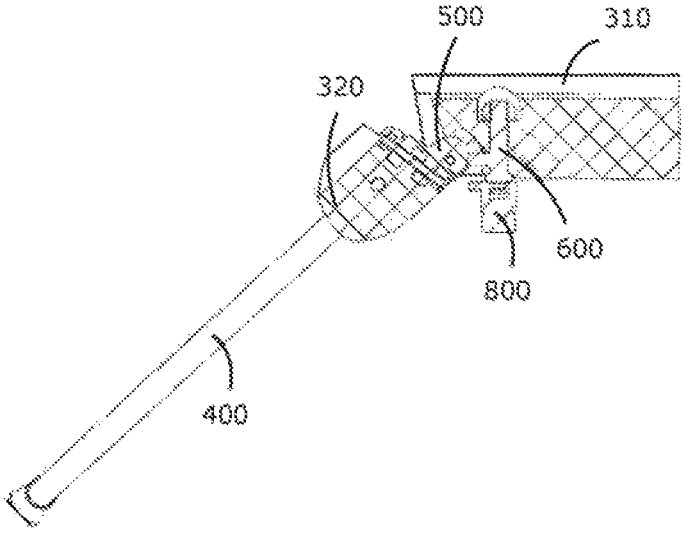
FIG. 17*b* is a cross-sectional side view of the forestock taken along line L-L of FIG. 17*a;*
Figure 17C:
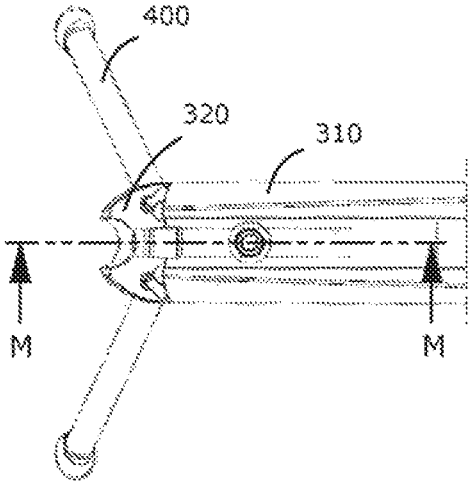
FIG. 17*c* is a tip view of the two part forestock of FIG. 17*a* and showing the tip and bipod legs angled away from the forestock in a second position.
Figure 17D:
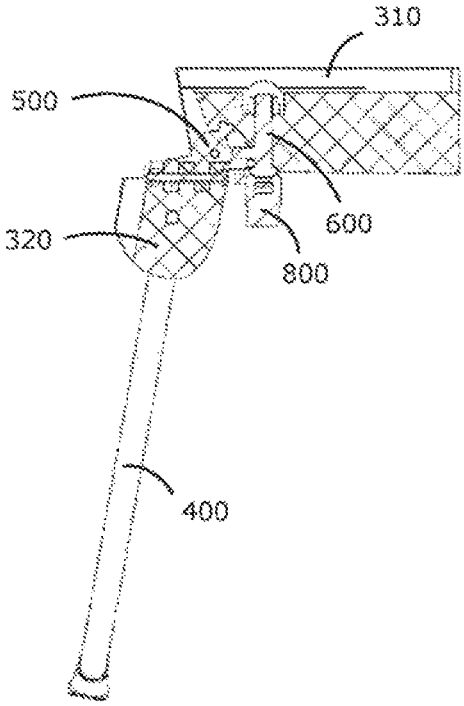
FIG. 17*d* is a cross-sectional side view of the forestock taken along line M-M of FIG. 17*c*.

The locking arm 620 is configured to rotate between an unlocked position, as shown in FIGS. 14*b* and 16*b*, and a locked position, as shown in FIGS. 14*e*, 17*b*, and 17*d*. To lock the tip 320 in the operational position, the gripping member is rotated to cause the locking arm 620 to press against the locking surface 523 of the angle adjuster 520, as shown in FIG. 16*d*, or against the base of the angle adjuster, as shown in FIGS. 14*e* and 16*f* forestock. In the locked position, the locking arm prevents the tip 320 from moving from the operational position to the standard position.

To adjust the position of the tip, the lock 600 must first be unlocked by rotating the gripping member 630 to cause the locking arm 620 to disengage from the angle adjuster 520. When the lock is unlocked, the tip 320 may move between the operational position and the storage position by rotating the tip 320 until it substantially aligns with the forestock body 310. Alternatively, the tip may be moved between a first operational position at which the tip hinges from the forestock body at a first angle and a second operational position at which the tip hinges from the forestock body at a second angle. The first angle may be less than or greater than the second angle, as shown in FIGS. 17*a* to 17*d*. By adjusting the angle of the tip 320 to the forestock body 310, the angle at which the bipod legs 400 project from the forestock body 310 is adjusted accordingly. Therefore, it is possible to adjust the angle of the rifle 100 with respect to the ground by adjusting the angle of the tip 320 to the body 310.

Figure 15A:
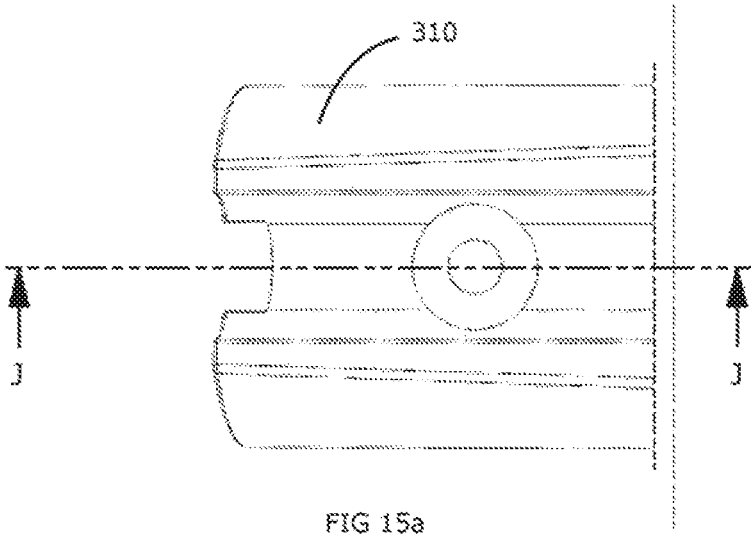
FIG. 15*a* is a top view of a portion of the distal end portion of one form of forestock body according to the invention.
Figure 15B:
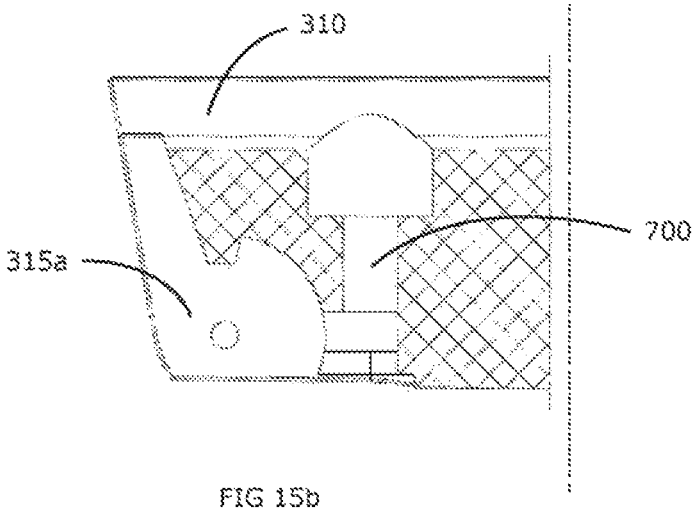
FIG. 15*b* is a cross-sectional side view taken along line 3-3 of FIG. 15*a;*
Figure 15C:
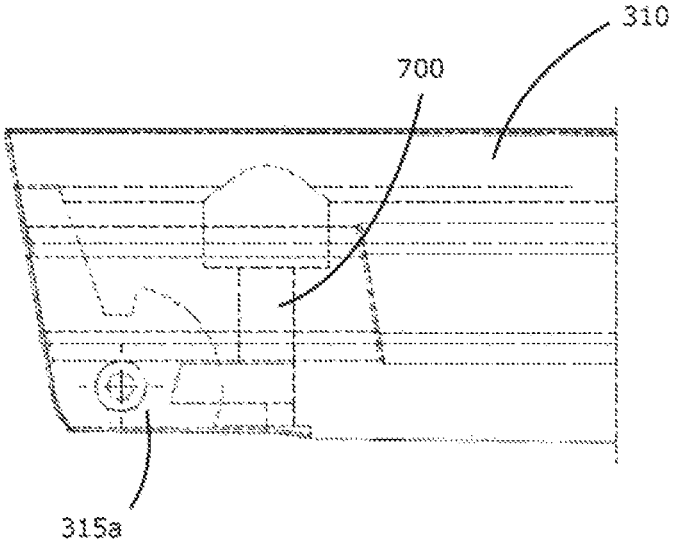
FIG. 15*c* is a side view of the forestock body shown in FIGS. 15*a* and 15*b* and showing hidden detail of a non-compressive lock having a locking arm in a locked position in which the locking arm projects into the pivot member cavity.
Figure 15D:
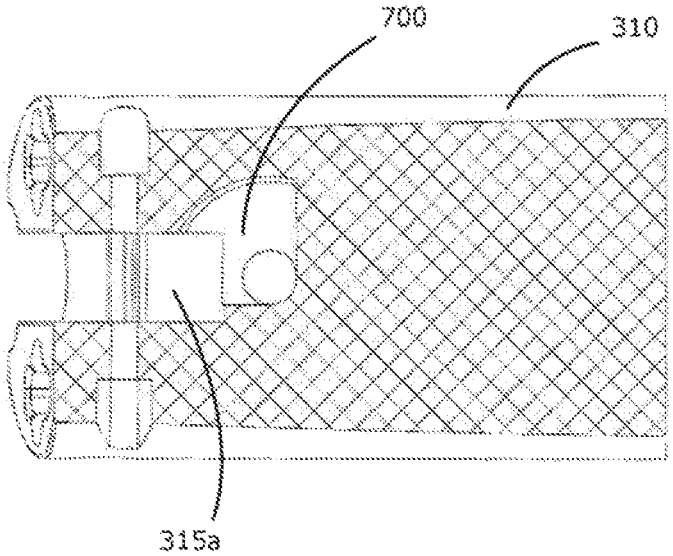
FIG. 15*d* is a cross-sectional top view of the forestock body shown in FIGS. 15*a* and 15*b* and showing the lock housing for a substantially non-compressive lock from above, where the lock housing extends in an arc to allow the locking arm of the lock to rotate toward and away from the pivot member in the pivot member cavity.

To use the bipod of a two part forestock having two bipod legs and a non-compressive lock, as described above, the bipod legs 400 are first retracted from the bipod housing until the legs 400 reach the point of full extension. The tip 320 may be unlocked by rotating the gripping member 630 of the lock in a first direction to reach the unlocked position. This causes the locking arm 620 to rotate away from and disengage with the angle adjuster 520 by rotating within the lock housing 700, which comprises a space within which the locking arm can rotate back and forth, as shown in FIG. 15*b*. The user can then hinge the tip 320 downwardly, away from the forestock body 310 to a desired angle up until the point of maximum rotation where the pivot member foot 525 contacts an obstruction, such as the end wall 319, in the pivot member cavity 315*a*. When the tip 320 is at the desired angle, the user can rotate the gripping member 630 in a second direction to cause the locking arm 620 to engage with an appropriate locking element 570 of the pivot member 500 to prevent further rotation of the pivot member 500 about its first axis and therefore to prevent further rotation of the tip about the first axis. The tip 320 is now locked in position and the bipod legs 400 extend beneath the tip 320 to contact the ground and support the rifle 100. Where the pivot member 500 is configured to rotate about a second axis, a user may pivot the tip 320 to one side or the other to steady the rifle 100 on uneven ground.

To return the bipod to its housing, the tip 320 is unlocked with the gripping member 630 and moved back to its storage position where the tip is aligned with the forestock body 310. If desired, the tip 320 may be locked in the storage position by engaging the locking arm 620 with an appropriate locking element 570 through manipulation of the gripping member 630. The legs 400 are then pushed hack into the bipod housing.

One method of assembling the two part forestock, the body of the forestock may be formed in two parts, such as two halves, that are joined together, such as by screwing or welding the parts together for example. The tip may also be formed in two parts. Magnets may be placed in each part to splay the bipod legs apart and the two tip parts may then be joined together, by welding or any other suitable means. Alternatively, the tip and magnets may be co-moulded together so that the tip is formed as a single part. Other methods to assemble to the forestock may be used instead without departing from the scope of the invention.

The rifle with bipod provides a convenient and simple way to stabilise a rifle. The bipod may be housed within the forestock when not in use. In this arrangement, the bipod legs are unlikely to become caught on foliage as the hunter moves through the bush with the rifle. The rifle is also better able to be placed within a rifle bag. In some forms, the bipod may be configured to support a rifle on uneven ground.

One or more of the components and functions illustrated in the figures may be rearranged and/or combined into a single component or embodied in several components without departing from the invention. Additional elements or components may also be added without departing from the invention.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

For example, although, in preferred forms of the invention, each bipod leg may comprise at least one leg stop to prevent the leg being removed from the bipod housing, each bipod leg may instead be configured to be removable from the bipod housing, as shown in FIGS. 18*a* and 18*b*. In this form, the bipod may comprise a pair of bipod legs, each having proximal ends configured to be placed within respective leg apertures formed in the distal end of the tip after the legs are removed from the bipod housing. The leg apertures are configured to hold the legs in position as the bipod supports the rifle. For example, the proximal end of each bipod leg may be threaded to engage with a respective threaded aperture formed in the distal end of the tip, so that the leg can be screwed into the distal end of the tip or unscrewed and returned to the storage position within the bipod housing. In another form, a snap fit or clip fit arrangement may be provided in which each bipod leg can be pushed into a respective leg aperture in the tip and held in place. To remove the leg, a user may pull the leg out of the leg aperture with sufficient force to release the engagement between the bipod leg and the tip of the forestock. The leg apertures may be angled toward the outer side surfaces of the tip 320 to splay the bipod legs 400 when the legs engage with the leg apertures. In another form, the bipod may comprise a single leg comprising a flared distal end or at least two splayed leg supports located at the base of the leg.

In yet another form, the bipod may comprise three or more legs.

The invention claimed is:

1. A forestock for use in a rifle, wherein the forestock comprises a body and a tip, wherein the tip is configured to hinge downwardly from the forestock body, and wherein the forestock further comprises:

a bipod housing comprising at least one bore that extends through the tip and into the body of the stock, and a bipod comprising at least one leg configured to slide back and forth within the bipod housing between a stored position, in which the leg is substantially held within the housing, and an extended position, in which the leg is substantially retracted from the housing.

2. The forestock according to claim 1, wherein the tip is attached to the forestock body via a pivot member comprising a first rotational member configured to rotate about a first axis to allow the tip to hinge downwardly from the body of the forestock when the bipod legs are in the extended position.

3. The forestock according to claim 2, wherein the pivot member further comprises a second rotational member configured to rotate about a second axis, which is substantially orthogonal to the first axis, to allow the tip to pivot from side to side.

4. A forestock according to claim 2, wherein the first rotational member comprises an angle adjuster comprising a first bore in which a first pivot shaft is located and wherein a longitudinal centre line of the first pivot shaft defines the first axis, and wherein the second rotational member comprises a sleeve comprising a second bore in which a second pivot shaft is located and wherein a longitudinal centre line of the second pivot shaft defines the second axis.

5. A forestock according to claim 4 and further comprising a lock configured to lock the tip in a hinged position.

6. The forestock according to claim 5, wherein the lock comprises a shaft, which is rotatable about its longitudinal axis, and a locking member projecting from the shaft, wherein rotating the shaft to a first position causes the locking member to engage with a locking element of the angle adjuster and rotating the shaft to a second position causes the locking member to disengage with the locking element.

7. The forestock according to claim 6, wherein the lock further comprises a gripping member extending from one end of the shaft and through an aperture in the forestock body.

8. A forestock according to claim 4, wherein the angle adjuster further comprises a first face, a second face substantially opposing the first face, and a side surface forming a locking surface between the first and second side faces, wherein the first bore extends through the angle adjuster from the first face to the second face and wherein the locking surface comprises one or more locking elements configured to engage with a lock to lock the position of the tip in relation to the forestock body.

9. A forestock according to claim 8, wherein the locking surface comprises two or more locking elements and the lock is configured to engage with any of the locking elements allow the tip to be locked at different angles relative to the forestock body.

10. A forestock according to claim 8, wherein the lock is housed within a lock housing in the forestock body and wherein the lock comprises a locking member configured to project toward the angle adjuster and to engage with a locking element of the angle adjuster to lock the tip in position and to retract or rotate away from the angle adjuster to disengage with the locking element to unlock the position of the tip.

11. A forestock according to claim 10, wherein the locking element comprises an abutment surface to press against the locking member in a locked position.

12. The forestock according to claim 11, wherein the abutment surface is defined by a side surface of a recess formed in the angle adjuster, a side edge of an aperture formed in the angle adjuster, a side surface of a projection extending from the angle adjuster, or a lower surface of the angle adjuster.

13. The forestock according to claim 1, wherein the bipod comprises a pair of legs.

14. The forestock according to claim 13, wherein the bipod housing comprises a pair of bores, each bore being configured to store one of the bipod legs therein.

15. A forestock according to claim 14, wherein each bipod leg comprises a proximal end that is held within the respective bore of the forestock and a distal end comprising a foot, and wherein the bipod comprises a biasing system that engages with the proximal ends of the bipod legs to move the proximal ends towards each other and to splay the feet apart when the bipod legs are in the extended position.

16. A forestock according to claim 15, wherein the biasing system comprises a magnet located at the proximal end of each bipod leg to engage with a corresponding magnet located within the bipod housing.

17. A forestock according to claim 1, wherein the at least one bore of the stock comprises a flared opening.

18. A forestock according to claim 1, wherein the at least one leg comprises a substantially elliptical lateral cross-section.

19. A rifle comprising a forestock according to claim 1, and a barrel supported by the stock.

* * * * *